United States Patent [19]

Kindig et al.

[11] Patent Number: 4,743,271

[45] Date of Patent: May 10, 1988

[54] PROCESS FOR PRODUCING A CLEAN HYDROCARBON FUEL

[75] Inventors: James K. Kindig, Englewood; James E. Reynolds, Golden, both of Colo.

[73] Assignee: Williams Technologies, Inc., Tulsa, Okla.

[21] Appl. No.: 606,847

[22] Filed: May 2, 1984

Related U.S. Application Data

[63] Continuation-in-part of Ser. No. 467,382, Feb. 17, 1983, abandoned.

[51] Int. Cl.[4] ..... C10L 9/02; C10L 9/06

[52] U.S. Cl. ..... 44/621; 201/17; 44/622; 423/460; 423/481; 423/483; 423/484

[58] Field of Search ..... 44/1 SR, 1 R; 423/484, 423/481, 464, DIG. 126, 483, 488, 460; 201/17

[56] References Cited

U.S. PATENT DOCUMENTS

| | | | |
|---|---|---|---|
| 2,808,369 | 10/1957 | Hickey | 423/461 |
| 3,073,676 | 1/1963 | Mollard et al. | 423/484 |
| 3,107,148 | 10/1963 | Brooks | 423/483 |
| 3,653,811 | 4/1972 | Zagorskaya et al. | 423/448 |
| 3,825,655 | 7/1974 | Heltaver et al. | 423/483 |
| 3,863,846 | 2/1975 | Keller et al. | 241/1 |
| 3,876,237 | 3/1975 | Aldrich | 241/1 |
| 3,918,761 | 11/1975 | Aldrich | 175/64 |
| 3,926,575 | 12/1975 | Meyers | 44/1 SR |
| 3,961,030 | 6/1976 | Wiewiorowski et al. | 423/126 |
| 4,032,621 | 6/1977 | Meadows | 423/483 |
| 4,069,296 | 1/1978 | Haung | 423/127 |
| 4,071,328 | 1/1978 | Sinke | 44/1 SR |
| 4,080,176 | 3/1978 | Verschuur | 44/1 SR |
| 4,081,251 | 3/1978 | Colli | 44/1 SR |
| 4,083,940 | 4/1978 | Das | 423/449 |
| 4,119,410 | 10/1978 | Kindig et al. | 44/1 SR |
| 4,120,939 | 10/1978 | Ehlig | 423/483 |
| 4,134,737 | 1/1979 | Yang | 44/1 SR |
| 4,158,701 | 6/1979 | Anderson et al. | 423/484 |
| 4,160,809 | 7/1979 | Anderson et al. | 423/484 |
| 4,163,045 | 7/1979 | van der Meer et al. | 423/483 |
| 4,169,710 | 10/1979 | Jensen | 44/1 SR |
| 4,192,650 | 3/1980 | Seitzer | 44/1 R |
| 4,213,765 | 7/1980 | Wilson | 44/1 SR |
| 4,239,735 | 12/1980 | Eisele et al. | 423/126 |
| 4,260,394 | 4/1981 | Rich | 44/1 SR |
| 4,278,442 | 7/1981 | Matsuda et al. | 44/1 SR |
| 4,294,816 | 10/1981 | Kruger et al. | 423/484 |
| 4,305,726 | 12/1981 | Brown, Jr. | 44/1 SR |
| 4,324,560 | 4/1982 | Fonseca | 44/1 SR |
| 4,325,707 | 4/1982 | Kalvinskas et al. | 44/1 SR |
| 4,355,017 | 10/1982 | Gamson et al. | 423/484 |
| 4,377,391 | 3/1983 | Cotell | 44/1 SR |
| 4,695,290 | 9/1987 | Kindig et al. | 44/1 SR |

FOREIGN PATENT DOCUMENTS

| | | | |
|---|---|---|---|
| 26200 | 3/1983 | Australia | 44/1 R |
| 23235 | 7/1983 | Australia | 44/1 R |
| 31282 | 7/1983 | Australia | 44/1 R |
| 0027493 | 4/1981 | European Pat. Off. | 423/484 |
| 0016624 | 10/1981 | European Pat. Off. | 44/1 SR |
| 00094 | 12/1984 | PCT Int'l Appl. | 44/1 R |

OTHER PUBLICATIONS

Bureau of Mines Report of Investigations, No. 5191, "Coal as a Source of Electrode Carbon in Aluminum Production", (Feb. 1956) (p. 7+).

Wolfkovich et al., *Comptes Rendus (Doklady) De l'Academie des Sciences de L'URSS*, 1942, vol. 16, No. 1, pp. 21–23.

*Primary Examiner*—Helen M. S. Sneed
*Assistant Examiner*—Helane Myers
*Attorney, Agent, or Firm*—Sheridan, Ross & McIntosh

[57] ABSTRACT

This invention discloses processes for the treatment of coal and coal derivatives in order to remove contaminates to produce a high purity coal product. The processes generally comprise a sequential acid leaching in which a hydrofluoric acid leach is followed by a hydrochloric acid leach. The pyrite and other heavy metals from the coal are removed by physical separation, either gravity or magnetic separation. The leached coal is then treated either by a washing and drying step or by a heat treatment to remove volatile halides. The HF acid and the HCl acid leachates are recovered for regeneration of the respective leachates and are recycled for use in the leaching steps. In additional processing, the coal may be pre-treated by a mild HCl acid leach and by pre-drying or physical beneficiation of the coal feedstock.

23 Claims, 1 Drawing Sheet

PROCESS FOR PRODUCING A CLEAN HYDROCARBON FUEL

This is a continuation-in-part of U.S. patent application Ser. No. 06/467,382, filed Feb. 17, 1983 now abandoned.

FIELD OF INVENTION

This invention relates to processes for producing environmentally acceptable fuels from coal and, in particular, to hydrometallurgical processes for removing contaminants from coal.

BACKGROUND OF THE INVENTION

Energy demands by the industrialized world are continuing to rise, while the rate of new oil discoveries is falling. Within the next 30 years, available petroleum supplies will fail to meet demand, and oil will no longer be able to serve as the world's major energy source. Other energy sources such as geothermal, solar, and fusion are unlikely to be sufficiently developed to serve as replacements for oil. Coal, on the other hand, exists in relative abundance in the United States, and if it can be adapted to use in existing plants which have been engineered for petroleum use, it can serve as an inexpensive substitute for, and successor to, the more expensive oil fuels in use today. In order to be used as an oil substitute, however, the coal must be converted to a fluid state, so that systems burning fuel oil, diesel fuel, and other petroleum products can be adapted to its use with minimal equipment modification. The coal must also be cleaned, or purged of its mineral matter (ash precursor) content, to increase fuel value per pound for efficient handling and use; and its sulfur content must be reduced to minimize offgas cleanup, so as to meet environmental pollution standards.

It has been reported that treating raw, lump coal with hydrogen fluoride in liquid or gaseous form removes much of the ash content, and this removal of ash from the interstices within the coal tends to cause the coal to break up, so that the hydrogen fluoride also serves as a comminuting agent to produce coal fines. The coal particles produced, however, are still too large to be used as fluid fuel substitutes. In addition, hydrogen fluoride is an extremely expensive reagent, so that its use is uneconomical unless it can be recycled. The present invention solves these problems by providing an integrated process for the use of hydrogen fluoride to clean coal followed by a sequential HCl acid leaching step. The preferred embodiment of this invention includes separate regeneration schemes for the hydrogen fluoride acid leachate and hydrogen chloride acid leachate for recycle for use in the respective fluid systems. Valuable mineral by-products, such as aluminum and titanium compounds, or compounds of other elements contained in the mineral matter associated with the feed coal, may also be recovered from the process.

The finely-ground, acid-purged coal product is usable not only as a substitute for petroleum fuels, e.g., as a turbine fuel, but also may substitute for activated carbon, or as a feedstock for carbon black, electrode carbon, and various chemical processes.

BRIEF DESCRIPTION OF THE PRIOR ART

U.S. Pat. No. 4,169,710 assigned to Chevron describes a process for the use of concentrated hydrogen halide, such as hydrogen fluoride, as a comminuting agent for raw coal. The patent also discloses the use of the hydrogen halide to dissolve and remove ash and sulfur from raw (unground) coal in a single step treatment. It does not provide for a sequential two-acid leach system. This patent also mentions that the hydrogen halide may be purified and recycled; however, no procedure for doing so is disclosed. The Chevron patent does not disclose the use of finely-ground, hydrogen fluoride-purged coal as a substitute for fluid fuels or other forms of finely-divided, highly purified hydrocarbons.

European Patent Application No. 80300800.2, filed Mar. 14, 1980, and published Oct. 1, 1980, under Publication No. 0 016 624, by Kinneret Enterprises, Ltd., discloses a coal de-ashing process utilizing liquid or gaseous hydrogen fluoride to remove silica and/or aluminum bearing mineral matter and other reactive materials from substances, such as coal, which do not react with hydrogen fluoride under the same conditions. The hydrogen fluoride is recovered as a gaseous product at several stages. In the Kinneret process, hydrogen fluoride in gaseous form contacts the coal, which is first ground to −200 mesh. The unreacted gas is then separated by density methods and recycled. An aqueous solution of 20–30% hydrogen fluoride is then used to leach the formed fluoride minerals away from the coal, and hydrogen fluoride gas is recovered from this solution at raised temperatures and pressures, simultaneously causing the crystallization of aluminum, calcium, magnesium, and manganese fluorides. Other minerals including titanium, potassium, and sodium fluorides remain in solution. The heavy gas fraction resulting from the hydrogen fluoride gas treatment of the coal is contacted at elevated temperatures and pressures with water in two subsequent stages to remove sulfur and silicon dioxide and produce gaseous hydrogen fluoride in both cases for recycle. The Kinneret process does not utilize the advantages of an HCl acid leach following the HF treatment. The Kinneret publication discloses the comminution of a coal prior to treating with hydrogen fluoride to remove mineral content, it does not disclose a procedure for producing a finely-ground product suitable as a liquid fuel substitute or other applications as discussed above.

U.S. Pat. No. 4,083,940 to Das discloses the use of a 0.5–10% hydrofluoric acid solution in combination with an oxidizing agent such as nitric acid, to purify coal to electrode purity (0.17% ash). A gaseous oxygen-containing materal is bubbled through the mixture during leaching to provide additional mixing action and oxidation.

U.S. Pat. No. 3,961,030 to Wiewiorowski et al. describes the use of a 10–80% hydrogen fluoride solution to leach clay for the recovery of aluminum. Hydrogen fluoride is recovered for recycle by the addition of water and heat to aluminum fluoride. The recovered hydrogen fluoride can be dissolved in water and recycled in aqueous form.

U.S. Pat. No. 2,808,369 to Hickey describes the treatment of coal with fluoride salts, and with hydrogen fluoride gas, after first heating the coal to effect a partial devolatilization.

U.S. Pat. No. 4,071,328 to Sinke describes the removal of FeS from coal by hydrogenation and contact with aqueous hydrogen fluoride.

U.S. Pat. Nos. 3,870,237 and 3,918,761 to Aldrich disclose the use of moist ammonia for in situ treatment of coal to fragment the coal and facilitate the separation of inorganic components.

U.S. Pat. No. 3,863,846 to Keller, Jr., et al. describes an apparatus and method for the utlization of anhydrous ammonia as a coal comminuting agent.

Bureau of Mines Report of Inventigations No. 5191, "Coal As A Source of Electrode Carbon In Aluminum Production," (February, 1956) at page 7 discloses the use of froth flotation followed by hydrofluoric-hydrochloric acid leaching, using a solution containing 5 parts of the combined acids to 95 parts water. At page 29, the use of a 2.44 Normal solution of hydrofluoric-hydrochloric acid is used to leach coal.

SUMMARY OF THE INVENTION

The present invention provides processes for producing a high-purity coal product with less than about 5 weight percent impurities therein in which the coal product is suitable for use as a substitute for petroleum fuels. The processes generally comprise the following steps: (a) contacting coal of a size less than about an inch with an aqueous HF acid leach to solubilize at least a portion of the coal mineral matter; (b) separating the spent HF leach and dissolved impurities therein from the coal; (c) contacting said coal with an aqueous HCl acid leach to solubilize additional coal mineral matter; (d) separating the spent HCl leach and impurities dissolved therein from the coal; (e) separating the pyrite from the coal; (f) washing and drying the coal to remove residual contaminants, including $Cl^-$ and $F^-$ ions; and (g) regenerating the spent acid leach liquor and recycling said acid for use in the respective sequential leaches. In a preferred embodiment, the coal feed material is pre-treated by an HCl acid pre-leach, particularly for coals containing high levels of calcium. In another preferred embodiment, in an alternative or in addition to the washing and drying step, the coal product may be thermally treated to remove low volatile contaminates.

DETAILED DESCRIPTION

Figure 1:
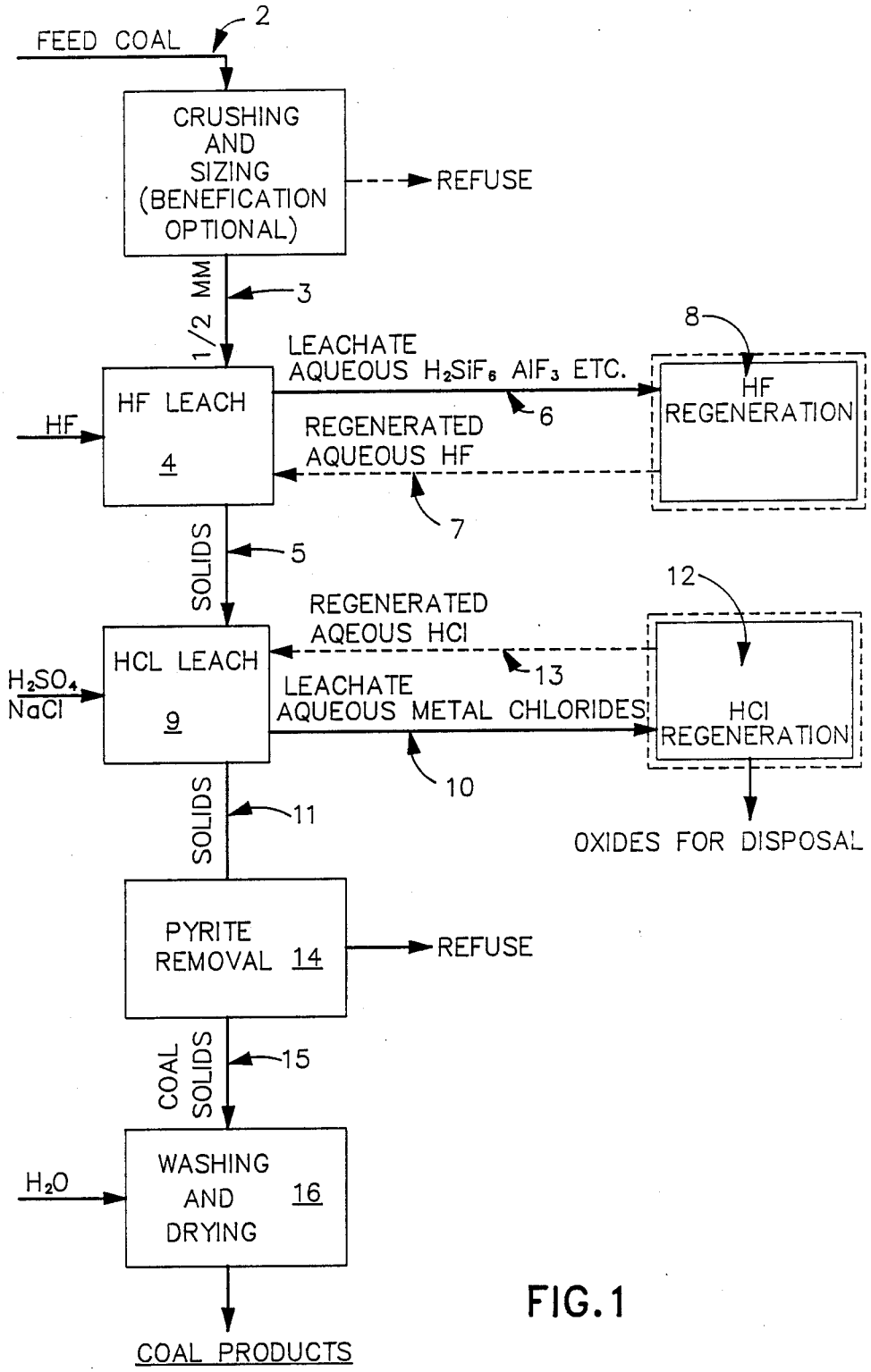
FIG. 1 is a schematic flow diagram of one embodiment of the present invention.

The processes of the present invention combine sequential hydrofluoric acid leaching and hydrochloric acid leaching of the coal with specific additional steps to obtain coal product substantially free of contaminants, i.e. a product containing less than 1%, more preferably less than 0.5, and most preferably less than 0.2 weight percent ash. Virtually any coal solid; i.e., solid hydrocarbon including peat, coal, lignite, brown coal, gilsonite, tar sand, etc., including coal derived products (hereinafter collectively referred to as "coal") may be treated by the processes of the present invention. Coal is a random mixture of dozens of minerals and moisture (impurities) with the hydrocarbons. The mixture varies from deposit to deposit, affected by differences in the original vegetation, heat, pressure, hydrology, and geologic age. Table A lists the common minerals found in coal.

TABLE A

Common Minerals Found in Coal

Muscovite ($KAl_2(AlSiO_3O_{10})(OH)_2$)
Hydromuscovite
Illite ($K(MgAl,Si)(Al,Si_3)O_{10}(OH)_8$
Bravaisite
Montmorillonite $(MgAl)_8(Si_4O_{10})_3(OH)_{10}12H_2O$
Kaolinite ($Al_2Si_2O_5(OH)_4$)
Levisite
Metahalloysite
Siderite ($FeCO_3$)
Sylvite (KCl)
Halite (NaCl)
Quartz ($SiO_2$)
Feldspar $(K,Na)_2OAl_2O_36SiO_2$
Zircon ($ZrSiO_4$)
Prochlorite ($2FeO2MgOAl_2O_32SiO_22H_2O$)
Chlorite $(Mg,Fe,Al)_6(Si,Al)_4O_{10}(OH)_8$
Diaspore ($Al_2O_3H_2O$)
Lepidocrocite ($Fe_2O_3H_2O$)
Kyanite ($Al_2O_3SiO_2$)
Staurolite ($2FeO5Al_2O_34SiO_2H_2O$)
Topaz $(AlF)_2SiO_4$
Tourmaline $H_9Al_3(BOH)_2Si_4O_{19}$
Pyrophyllite ($Al_2Si_4O_{10}(OH)_2$)
Penninite ($5MgOAl_2O_33SiO_22H_2O$)
Ankerite $CaCO_3(Mg,Fe,Mn)Co_3$
Garnet ($3CaOAl_2O_33SiO_2$)
Hornblende ($CaO3FeO4SiO_2$)
Apatite ($9CaO3P_2O_5CaF_2$)
Epidote ($4CaO3Al_2O_36SiO_2H_2O$)
Biotite ($K_2OMgOAl_2O_33SiO_2H_2O$)
Augite ($CaOMgO2SiO_2$)
Calcite ($CaCO_3$)
Hematite ($Fe_3O_4$)
Magnetite ($Fe_2O_3$)
Gypsum ($CaSO_42H_2O$)
Barite ($BaSO_4$)
Pyrite ($FeS_2$)
Marcasite ($FeS_2$)
Sphalerite (ZnS)

The minerals (precursors of ash) in coal impede the combustion of the hydrocarbons and create problems ranging from ash removal to the release of airborne pollutants, e.g. oxides of the sulfur which are present in coal dominantly in two forms, pyritic and organic.

In the practice of the present invention the particular combination of process steps and/or the process conditions for such steps are in large part determined by the level and nature of impurities in the particular feed coal.

Pre-acid leach treatments: Depending on the particular feed, it may be advantageous to physically and/or chemically pre-treat the coal feed prior to leaching.

A. Physical Separation—For coals that are high in gangue materials, previously described, the gangue should be physically separated from the coal prior to other treatment, provided the separation process is not accompanied with a concommitant high loss of heating value.

B. Drying—Feed coal such as sub-bituminous lignites or other low-rank coals may be dried prior to further treatment. Where the feed is Western, U.S. sub-bituminous coal which typically contains about 25 weight percent moisture it is particularly advantageous to dry the feed to substantially reduce this inherent moisture content, preferably to below about 5 percent by weight.

C. Crushing/Sizing—With most feeds, the contaminant removal process is enhanced by crushing or sizing the feed to a particular size, e.g. less than about 1 inch, typically less than 10 mm, preferably less than about 5 mm, and more preferably less than about ½ mm.

D. HCl Leach—Some feeds, and in particular, those with relatively high amounts of ash minerals containing calcium, such as calcite and dolomite, are advantageously pre-leached with a mild, sometimes cold, hydrochloric acid leach whereby calcium and magnesium which might otherwise interface with the HF leach are precluded entry into the HF circuit where insoluble fluorides ($CaF_2$ and $MgF_2$) would be formed and the fluorine subsequently lost.

By mild leach is meant one of less than about 20 weight percent HCl and temperatures below about 40° C. In some instances, however, this HCl pre-leach may be carried out at higher temperatures, e.g. from about 40° C. to boiling. Leaching times of about 1 hour are typically effective for 96% calcium removal at 10% acid, but up to 4 hours may be used. In general, conditions of acid strength, time and temperature are adjusted to effect calcium removal to a level of less than about 1000 ppm. Following leaching, a solid/liquid separation is made, the solids are washed and then proceed to the HF leach. The spent HCl pre-leach liquor is recaptured and regenerated.

HYDROFLUORIC ACID LEACH

According to the processes of the present invention the coal feed, optionally pre-treated by one or more of the pre-leach treatments described hereinbefore, is contacted with hydrofluoric acid at ambient pressure. Of the 39 minerals listed in Table A, HF is extremely reactive in attacking the first 31 therein listed, particularly, the silicates and especially aluminosilicates including clays and shales. The HF is not reactive with the hydrocarbons in coal. During the HF leach, the ash-forming silicates are dissolved whether they are free (liberated); attached to coal; contained in any crack, cleat or pore accessible to the leach solution; or even attached to pyrite.

A standard two-stage countercurrent leach is typically employed. In the second stage, fresh 20% HF is advantageously employed to contact partially leached coal discharged from the first or acid-kill stage. In the first stage, partially spent acid from the second stage may be largely neutralized with fresh coal. Typical leaching time is a total of about four hours.

After the HF acid leach, the spent HF acid and the dissolved impurities are separated from the partially purified coal. The separated coal is typically washed, by methods known in the art with water, or with dilute HF acid, followed by a water wash. The separated coal is then leached with an HCl leach as described hereinbelow.

HYDROCHLORIC LEACH

The HCl acid leach effects further mineral impurity removal, particularly, calcium and remaining aluminum. Typically, a co-current leach is contemplated for the HCl acid leach. Hydrochloric acid of about 10 weight percent concentration is preferred at a temperature of about 90° C. and a leach time of approximately 1 hour. Following the hydrochloric leach, the spent HCl acid and dissolved impurities are separated from the acid-treated coal solids. The separated coal is washed by methods known in the art with water, or with dilute HCl acid, followed by a water leach. However, the HF leach and the HCl leach are insufficient to remove the contaminants to the levels otherwise achievable according to the present invention. Accordingly, the acid treated coal solids of the present invention undergoes further treatment as disclosed hereinbelow.

ACID REGENERATION

As will be known and understood by those skilled in the art subsequent to either or both acid leaches, acid may be regenerated from the leach liquor following a liquid/solid separation and advantageously recycled. HF recovery can be effected by a number of methods including (1) evaporation of the pregnant HF leach liquor to maintain a water balance; and (2) pyrohydrolysis of the evaporated stream to produce HF for recycle and mixed oxides for disposal. Other methods which provide for separate recovery of assorted minerals may also be used, such as solvent extraction prior to pyrohydrolysis to extract elements of commercial value, e.g. titanium and chromium.

Different HCl regeneration systems are preferred depending upon the level of calcium and magnesium in the feed. For Eastern coal (low levels) the pregnant liquor from the HCl leach can be evaporated and pyrohydrolized to produce oxides and HCl for reuse. For Western coal, precipitation of gypsum (calcium sulfate) provides the driving force for introducing acid (hydrogen ions from sulfuric acid) into the chloride system with production of HCl as follows:

$$H_2SO_4 + CaCl_2 \rightarrow CaSO_4 + 2HCl.$$

PYRITE REMOVAL

Gravity (including tabling) or other physical, including physio-chemical, separations are facilitated by the removal of virtually all non-pyritic (aluminosilicate and other non-sulfides) mineral matter according to the leach steps of the present invention. This is due to the fact that both coal and pyrite move toward their natural specific gravities, about 1.3 and 5.2, respectively, as aluminosilicate (specific gravity 2.6) and other non-sulfides locked to coal and pyrite are dissolved away. The large differences in the specific gravities, magnetic susceptibilities, surface properties, etc. of coal and pyrite solids after HF and HCl leaching for mineral matter removal are examples of material differences in physical properties which may be used to effect a separation between pyrite and coal. For purposes of the present invention, pyrite is physically separated from the coal either by gravity separation techniques known in the art or by magnetic separation. Such physical separation is possible because the upstream processing according to the present invention chemically liberates the pyrite by dissolution of the aluminosilicate and other non-sulfides encasing the pyrite.

WASHING

Washing the coal product to remove dissolved cations and anions can be advantageously effected by any number of systems and washes. Typically, a multiple (four) stage countercurrent decantation (CCD) system with minimum water addition may be used. The CCD circuit may optionally be operated in conjunction with filters and/or centrifuges. In such a system, retention time is about twelve hours during which there is adequate diffusion of halogens from the coal product. In addition to long-term washing with water, as in a multistage CCD circuit, additional halogen removal can also be effected by addition of various compounds to accelerate water washing such as acetic acid, alcohol (90% ethanol, 5% methanol, and 5% isopropyl), and ammonium hydroxide, and by heating the water or compounds just described to a point below boiling or by thermal treatment described below.

The coal product of the present invention has fast thickening and filtration rates as compared to conventional coal slurries, due to the absence of clays which have been removed upstream.

HEAT TREATMENT

As an alternative or in addition to washing with water or solutions previously described, the coal product may be thermally treated for example, by baking to a temperature below about that of incipient loss of hydrocarbon volatiles, typically from about 225° to about 400° C., preferably about 300° to 350° C., for a sufficient time, e.g. to achieve halogen removal to less than about ½ percent by weight. The upper temperature is in large part determined by a desire to avoid loss of hydrocarbon value through driving off low volatizing components. As will be understood by those skilled in the art, removal of halogen volatiles can be effected by use of a sweep gas, typically an inert gas such as $N_2$, passing over the coal during heating. It has been discovered that addition of $H_2O$ as water vapor to the sweep gas, i.e. in comparison to $N_2$, $CO_2$, and the like, results in enhanced halogen removal. It has further been discovered that addition of ammonia, both with and without water vapor, similarly results in unexpectedly enhanced halogen removal. Accordingly, two additional embodiments of the present invention comprise improved methods of removing halogen from coal and/or leached coal product as volatile halides comprising heating to a temperature of from about 225° C. to about 400° C., more particularly from about 300° C. to about 350° C., to drive off volatile halides. Typical volatile halides include $SiF_4$, from the breakdown of residual fluosilicic acid; $TiF_4$, by sublimination; $NH_4Cl$, formed by reaction of $NH_3$, water, and HCl adsorbed on the coal by sublimination; and $NH_4F$, formed by reaction of $NH_3$, water, and HF adsorbed on the coal by sublimination. The volatile halides are removed with a sweep gas comprising steam and/or ammonia.

Referring to FIG. 1, feed coal 2, typically Eastern coal, which may be subjected to physical beneficiation, is subjected to crushing or sizing to about 1" or less. In some instances, sizing to less than about 10 mm, preferably less than about 5 mm, and most preferably to approximately ½ mm may beneficially effect downstream process steps. Crushing or sizing may be by any means whereby the desired size feed particles are obtained. The sized coal feed 3 is then subjected to an HF leach 4, primarily for silicate and aluminosilicate removal. For some embodiments of the present invention, HF leaching may be under any conditions known in the art. In certain preferred embodiments, the HF leach is carried out with HF at concentrations of from 5 to 70 weight percent, more preferably between 15 and 30 weight percent, at temperatures of from about 10° C. to incipient boiling, more preferably between 10° and 40° C., and for time periods of from about 1/6 to about 8 hours, more preferably between 2 and 5 hours. The leaching may be co- or counter-current, the latter being preferred. The leach mixture undergoes one or more liquid/solid separations and washes by suitable means into a primary HF leachate 6 and barren HF-leached solids 5. It should be noted that during the solid/liquid separations after both the HF leach and optionally after the HCl leach it is particularly advantageous to separate leached fines with the spent acid as would occur by using cyclones. Not only will subsequent solid/liquid separations be facilitated, but when regeneration of the acids is by pyrohydrolysis, the fines advantageously comprise part of the fuel source to at least partially fire the pyrohydrolyzer. As shown by dotted lines 7, some or all of the regenerated leach 7 HF may be recycled after HF recovery and regeneration 8.

The HF acid regeneration 8, and HCl regeneration 12 are typically by pyrohydrolysis and sulfation. For acid regeneration by pyrohydrolysis/sulfation, acid leachate 6 is typically sprayed into a high temperature reactor in the presence of $O_2$, water vapor, and $SO_2$ (for sulfation) where the acid is regenerated and the dissolved constituents are largely converted into oxides and sulfates. Examples of the applicable chemical equations for pyrohydrolysis/sulfation regeneration follow:

HF acid regeneration $$2AlF_3+3H_2O\rightarrow Al_2O_3+6HF \quad (1)$$

$$SiF_4+2H_2O\rightarrow SiO_2+4HF \quad (2)$$

$$2FeF_3+3H_2O\rightarrow Fe_2O_3+6HF \quad (3)$$

$$CaF_2+H_2O+SO_2+0.5O_2\rightarrow CaSO_4+2HF \quad (4)$$

$$3H_2O+2FeCl_3\rightarrow 6HCl+Fe_2O_3 \quad (5)$$

$$2H_2O+2FeCl_2+\tfrac{1}{2}O_2\rightarrow 4HCl+Fe_2O_3 \quad (6)$$

$$3H_2O+2AlCl_3\rightarrow 6HCl+Al_2O_3 \quad (7)$$

$$2NaCl+H_2O+SO_2+0.5O_2\rightarrow Na_2SO_4+2HCl \quad (8)$$

$$2KCl+H_2O+SO_2+0.5O_2\rightarrow K_2SO_4+2HCl \quad (9)$$

$$CaCl_2+H_2O+SO_2+0.5O_2\rightarrow CaSO_4+2HCl \quad (10)$$

Equations 4, and 8 to 10 illustrate sulfation reaction reactions; equations 1 to 3, and 5 to 7 illustrate pyrohydrolysis reactions.

Prior to this step excess water contained in the spent acid leachate 6 may be evaporated (multiple effect evaporator, adiabatic cooling of hot gases, etc.) if desired.

Two advantages to the pyrohydrolysis/sulfation route for recovery of the acid are: (1) the waste product is essentially mixed oxides and sulfates or "ash" and constitutes a minimal problem for disposal; and (2) the returning HF (and HCl) are purified by passing through the vapor state as compared to alternate regeneration schemes which have an aqueous recycle stream which might recycle elements that would inhibit the leaching reaction.

The barren HF-leached solids 5, i.e. those obtained from solids/liquid separation of the HF leach mixture, are subjected to an HCl leach 9, primarily to effect calcium and final Al removal. While in some otherwise novel embodiments of the present invention, the HCl leach may be effected at any conditions, in some preferred embodiments the HCl leach is hot, i.e. at temperatures from about 40° C. to incipient boiling, more preferably from 80° C. to incipient boiling, using relatively strong acid concentrations, i.e. from about 3 to about 38 weight percent HCl, more preferably from 5 to 15 weight percent HCl, and for time periods from about 1/6 to about 4 hours, more preferably from 1 to 2 hours. The leach mixtures undergoes one or more liquid solids separations and washes by suitable means into a primary HCl leachate 10 and barren HCL-leached solids 11. The HCl leachate 10 may be regenerated 12 and recycled, as indicated by the dotted lines 13, for use in the HCl leach 9. In the regeneration 12, primary HCl leachate 12 may undergo evaporation and then pyrohydrolysis or sulfation whereby HCl is regenerated and metal oxides suitable for disposal are formed.

The barren HCl solids 11 obtained by liquid/solid separation following the HCl leach 9 will still contain the pyrite originally present in the coal feed. During pyrite removal 14, the pyrite is thus separated from the solids by any means of physical (gravity or other) separation, including the following: magnetic separation, heavy liquid separation, spiral separation, froth flotation, heavy media cyclone, tabling, etc. The resulting coal solids 15 are substantially free of pyrite.

The coal solids 15 undergo washing and drying 15 or thermal treatment to further remove anions and cations, i.e. contaminants including residual $Si^{4+}$, $Al^{3+}$, $Ti^{4+}$, $H^+$, $Cl^-$, and $F^-$ ions and moisture. In a preferred embodiment the coal solids are washed in a four (more or less) stage counter current decantation (CCD) system. The inherently long retention time of the CCD system provides ample time for diffusion of $Cl^-$ and $F^-$ ions. Hot water is more effective than cold, however, this is an economic trade off of operating versus capital cost.

In another preferred embodiment, the coal solids 15 undergo halogen removal 16 by thermal treatment by heating the solids to a temperature of incipient devolatilization. The thermal treatment is accomplished by heating to a temperature of from about 300° to about 350° C. for a time sufficient to remove any halogens and other contaminants present to an amount below about ½ percent by weight. Fluid bed or other equipment known to those skilled in the art may be employed. During the heating step it is useful to move a gas over or through the leached solids to remove any evolved halogens or moisture. Gases suitable for this include nitrogen, carbon dioxide and/or flue gas. Surprisingly, if water vapor is added to the sweep gas a much improved reduction of halogens occurs.

In certain instances, as for example where the feed coal is Western coal, typically containing high levels of calcium, magnesium, and/or moisture, certain additional steps are advantageously incorporated into the process. For example, reduction in moisture content by heating prior to crushing has been found to advantageously enhance the overall process.

Similarly, where the coal has a relatively high calcium content, a preferred embodiment provides an additional mild hydrochloric acid leach prior to the HF leach and a subsequent more severe HCl leach. Generally, conditions for the pre-leach are 1 to 20 weight percent HCl, more preferably 5 to 10 weight percent HCl. This weak hydrochloric acid leach at ambient temperature and pressure tends to remove the high calcium and magnesium (calcite and dolomite) content prior to the HF leaching. Acid from this HCl pre-leach may preferably be regenerated by pyrohydrolysis or by other techniques known to those skilled in the art.

Practice of the method of the present invention comprising contacting coal, preferably comminuted to a size of about 1 inch or less, with a sequential HF acid leach followed by a HCl acid leach comprising less than about 70 weight percent HF and less than about 38 weight percent HCl at atmospheric pressure and at a temperature below the respective acid's boiling point, preferably ambient temperature, to produce an acid treated coal product, results in unexpected efficient contaminant liberation and removal. In particular, an excess of about 85–90% of the alkali metals present are removed, typically 99% or more of the Na, Li and K present in Western coal is removed. In addition, liberation of pyrite is substantially complete allowing effective separation without loss of coal.

The following Examples are provided by way of illustration and not by way of limitation.

EXAMPLE 1

A series of experiments was performed on coal samples provided by Westmoreland Resources, Inc. from the Absaloka Mine in the Power River Basin near Hardin, Mont., prepared according to the following general method.

The 2-inch by zero sub-bituminous raw coal was crushed to minus ½-inch and a reserve sample was taken. The remaining coal was crushed to 4-mesh (Tyler) top size. After splitting out a head sample for analysis, the sample was wet-tabled on a laboratory-size Deister table to remove some of the high ash constituents. The various table products were analyzed for ash content. Based upon the resulting ash values, the clean coal and middling fractions were combined to form a clean coal composite. This composite was further processed to produce feed materials for the particle size tests, HF and HCl leach tests, and Pachuca washing tests.

For the sized coal leach tests, the various size fractions of the Westmoreland clean coal composite were prepared by screening through various Tyler sieve sizes. Five size fractions were prepared for testing: 4- by 8-mesh, 8- by 14-mesh, 14- by 28-mesh, 28- by 48-mesh and 48- by 100-mesh.

For the HF and HCl leach tests a portion of the clean coal composite was screened and resized to yield a 20- by 100-mesh fraction.

The feed material for the hydrochloric acid leach tests was further prepared according to the following general method.

The 20- by 100-mesh cleaned coal fraction previously described as the feed for HF tests was subjected to a two-stage agitation leach, and wash as described below.

First stage leach: 70% HF, 30% solids, ambient temperature (20°–30° C. range), one hour, atmospheric pressure (at 5,500 feet elevation).

Second stage leach: 38% HF, 30% solids, 90°–100° C., one hour, at atmospheric pressure (at 5,500 feet elevation).

Wash: mix moist, leached solids in boiling deionized water for 10 minutes, drain, rinse with cold deionized water on a 100-mesh brass screen.

The results of the analysis of the raw coal sample, the HF leached material and the feed to the HCl leach series are presented in Table 1.

TABLE 1

ANALYSES OF RAW FEED, FEED TO HF LEACH, AND FEED TO HCl LEACHES
(Analyses dry basis)

| | Raw Powder River Basin Feed | Feed to HF Leaches 20- by 100-Mesh Clean Coal from Tabling | Feed to HCl Leaches, HF Leached 20- by 100-Mesh Clean Coal from Tabling |
|---|---|---|---|
| Approximate, % | | | |
| Ash | 12.33 | 6.82 | 3.14 |
| Volatile | 39.20 | 42.75 | — |
| Fixed C | 48.47 | 50.43 | — |
| Total | 100.00 | 100.00 | 3.14 |
| Heating Value, Btu/lb | 11382 | 11755 | |
| Ultimate, % | | | |
| Carbon | 66.61 | 68.82 | — |
| Hydrogen | 4.52 | 4.92 | — |
| Nitrogen | 0.77 | 0.80 | — |
| Sulfur | 0.81 | 0.49 | — |
| Ash | 12.33 | 6.82 | — |
| Oxygen[1] | 14.96 | 18.15 | — |
| Total | 100.00 | 100.00 | — |
| Forms of Sulfur (as S), % | | | |
| Sulfate | 0.01 | 0.01 | — |
| Pyritic | 0.34 | 0.05 | — |
| Organic | 0.46 | 0.44 | — |
| Total | 0.81 | 0.49 | — |
| Elemental Analysis of Ash, Wt % of Ash | | | |
| $SiO_2$ | 36.70 | 35.16 | 1.15 |
| $Al_2O_3$ | 21.37 | 21.40 | 17.43 |
| $TiO_2$ | 0.52 | 0.99 | 0.12 |
| $Fe_2O_3$ | 4.90 | 1.44 | 3.83 |
| CaO | 19.86 | 25.45 | 42.48 |
| MgO | 1.52 | 4.28 | 6.74 |
| $Na_2O$ | 3.16 | 5.54 | 1.39 |
| $K_2O$ | 0.89 | 0.15 | 0.031 |
| $P_2O_5$ | 0.40 | 1.68 | — |
| $SO_3$ | 12.16 | 12.85 | 10.20 |
| Hardgrove Grindability Index at 21.74% $H_2O$ | 59.0 | — | — |
| Equilibrium Moisture % | 23.77 | — | — |
| Ash Fusion Temperatures, °F. | Oxidizing Atmosphere | | |
| Initial | 2170 | — | — |
| Softening | 2230 | — | — |
| Hemispherical | 2260 | — | — |
| Fluid | 2420 | — | — |
| | Reducing Atmosphere | | |
| Initial | 2060 | — | — |
| Softening | 2080 | — | — |
| Hemispherical | 2090 | — | — |
| Fluid | 2270 | — | — |

[1]By difference.

EXAMPLE 2

Sized Coal Leach Tests

To assess the effect of size during leaching, clean coal obtained by tabling crushed, raw Power River Basin coal from the Absaloka Mine of Westmoreland Resources, Inc. was sized into narrow size fractions and each size fraction separately leached under identical conditions as follows:

Two hundred grams of air-dried coal were added to 400 ml of 70% HF in a Teflon beaker. The mixture was agitated for one hour at room temperature with a polypropylene propeller driven by a mechanical stirrer. An 8-inch, 100-mesh (Tyler) brass screen was used to separate the solids from the leach solution. The minus 100-mesh solids and solution were stored and the solids were washed on the screen with two liters of boiling deionized water. This was followed by a one-minute rinse with cold deionized water.

The moist coal was returned to the Teflon beaker and 320 ml of boiling, 38% HF were added. A surface moisture of 40% was assumed for the moist coal feed to the leach. A hot plate was used to maintain a temperature of 90° to 100° C. for the one-hour agitated leach. The coal was drained and washed by the same method that followed the previous leach.

For the final leach, the moist coal was agitated with 320 ml of 20% HCl in the Teflon beaker at 90° to 100° C. for one hour. At the conclusion of the leach, the leached coal product was drained on the brass screen and washed with one liter of boiling, deionized water. While still on the screen, the leached coal was washed further with an upward-flowing stream of deionized water for two hours. The carbon products were drained, transferred to a graphite crucible, and baked in an atmosphere of nitrogen at 300° C. for two hours. After cooling in nitrogen, the sample was analyzed for ash content.

Analyses of the individual size fractions before and after ash removal treatment are presented in Table 2.

The leached product from the 14-by 28-mesh size fraction was ashed to provide material for determining the composition of ash, see Table 3.

TABLE 2

Summary of Sized Coal Leach Test Results for Westmoreland Coal, Absaloka Mine

| Size Fraction, Mesh | | Average | Feed | Ash Analysis, % Dry Basis | |
|---|---|---|---|---|---|
| Passing | Retained | Particle Size, mm[1] | Coal Weight % | Feed Coal | Leached Coal[2] |
| — | 4 | — | 0.1 | — | — |
| 4 | 8 | 3.331 | 19.6 | 8.62 | 3.18 |
| 8 | 14 | 1.661 | 37.0 | 8.21 | 2.52 |
| 14 | 28 | 0.829 | 22.9 | 6.75 | 1.01 |
| 28 | 48 | 0.417 | 12.1 | 6.57 | 0.58 |
| 48 | 100 | 0.208 | 7.2 | 6.95 | 0.53 |
| 100 | Pan | — | 1.2 | 8.05 | — |

[1]Geometric mean $(a \times b)^{0.5}$ of the indicated mesh sizes.
[2]Thoroughly washed and heat treated.

TABLE 3

Analysis of Ash from Leached Coal 14- × 28-mesh Westmoreland Coal, Absaloka Mine

| Ash Constituent | Analysis, % ICPES[1] |
|---|---|
| $SiO_2$ | 0.78 |
| $Al_2O_3$ | 14.20 |
| $TiO_2$ | 0.42 |
| $Fe_2O_3$ | 6.44 |
| CaO | 17.02 |
| MgO | 9.24 |
| $Na_2O$ | 2.04 |
| $K_2O$ | 0.08 |
| $P_2O_5$ | —[2] |
| $SO_3$ | 36.05[3] |
| $Cu_2O$ | 2.67[4] |

[1]Whole rock analysis, inductively coupled plasma emission spectrometer.
[2]Cannot be determined due to copper interference.
[3]Sulfur by Leco combustion.
[4]Not indigenous to sample, probably arises from brass screen used for solid liquid separations.

EXAMPLE 3

A series of tests were devised to examine the effect of various HF leach conditions on ash removal. The samples were prepared as follows.

A 200-gram portion of cleaned 20- by 100-mesh coal prepared as described in Example 1 was agitated at constant temperature with 1 liter (10% solids) of HF acid solution for four hours. Solid samples were removed from the slurry with a 100-mesh brass screen dipper at the following times: 10, 30, 60, and 240 minutes. Each sample was rinsed on a 100-mesh brass screen with deionized water before being transferred to a washing assembly for more thorough washing. The assembly consists of a series of cylindrical 50-ml plastic vessels with 100-mesh brass screen end caps and a 4-foot long tube 2⅜ inches in diameter to contain them. Each rinsed coal sample was placed into a vessel which was, in turn, inserted into the tube. After all the samples to be washed were in the tube, deionized water at a flow of approximately 6 liters per minute was passed upward through the tube and vessels for two hours. At the conclusion of the wash, the solids were drained and then baked in an atmosphere of nitrogen for two hours at 300° C.

The resulting samples were analyzed for ash content, and elemental ash analyses by ICPES. Tables 4 and 5 contain summaries of the test results.

TABLE 4

Aqueous HF Leaching Conditions and Results (10% solids in suspension)

| Test No. | Temp °C. | HF Conc % | Time min | Dry Ash, % | Percent in Ash $SiO_2$ | $Al_2O_3$ | CaO | MgO | $Fe_2O_3$ | $TiO_2$ | $Na_2O$ | $K_2O$ | $P_2O_5$ | $SO_3$ |
|---|---|---|---|---|---|---|---|---|---|---|---|---|---|---|
| Feed, 20 × 100[1] | | | | 6.82 | 35.16 | 21.40 | 25.45 | 4.28 | 1.44 | 0.99 | 5.54 | 0.15 | 1.68 | 12.85 |
| Tabled | | | | | | | | | | | | | | |
| 1 | 30 | 5 | 10 | 3.83 | 26.27 | 14.53 | 32.05 | 4.30 | 2.29 | 0.93 | 1.04 | 0.066 | 3.15 | 15.30 |
| | | | 240 | 3.77 | 11.65 | 16.18 | 36.08 | 6.52 | 2.74 | 0.65 | 3.22 | 0.068 | 1.31 | 12.60 |
| 2 | 30 | 15 | 10 | 3.45 | 16.83 | 11.98 | 35.96 | 4.82 | 3.54 | 0.74 | 1.13 | 0.063 | 1.27 | 17.45 |
| | | | 240 | 3.64 | 1.92 | 15.79 | 39.57 | 7.16 | 2.06 | 0.41 | 2.91 | 0.072 | 1.81 | 14.80 |
| 3 | 30 | 40 | 10 | 3.27 | 4.86 | 13.51 | 45.05 | 5.54 | 1.87 | 0.45 | 1.14 | 0.048 | 1.11 | 15.55 |
| | | | 240 | 3.25 | 1.19 | 15.60 | 44.26 | 6.97 | 3.15 | 0.18 | 1.48 | 0.049 | 1.62 | 14.02 |
| 4 | 30 | 70 | 10 | 2.86 | 7.59 | 9.08 | 48.47 | 6.04 | 2.48 | 0.22 | 0.68 | 0.032 | 3.07 | 13.88 |
| | | | 30 | 2.60 | 3.79 | 7.65 | 51.14 | 5.33 | 3.72 | 0.21 | 0.65 | 0.039 | 3.45 | 15.60 |
| | | | 60 | 2.67 | 3.32 | 6.84 | 49.27 | 4.87 | 8.08 | 0.15 | 0.55 | 0.097 | 4.21 | 19.98 |
| | | | 240 | 2.25 | 2.47 | 5.28 | 50.99 | 4.43 | 3.33 | 0.10 | 0.52 | 0.031 | 5.31 | 21.20 |
| 5 | 75 | 5 | 10 | 3.39 | 14.79 | 15.12 | 37.40 | 5.75 | 1.56 | 0.49 | 2.93 | 0.071 | 0.95 | 9.42 |
| | | | 30 | 3.59 | 11.55 | 13.96 | 38.40 | 5.92 | 2.02 | 0.48 | 2.88 | 0.056 | 1.83 | 12.70 |
| | | | 60 | 3.28 | 7.28 | 16.73 | 39.85 | 6.67 | 1.81 | 0.36 | 3.88 | 0.064 | 1.32 | 9.68 |
| | | | 240 | 3.68 | 2.80 | 17.45 | 39.73 | 7.13 | 2.40 | 0.25 | 5.52 | 0.058 | 1.52 | 9.35 |
| 6 | 75 | 15 | 10 | 3.55 | 6.23 | 14.29 | 44.38 | 6.24 | 2.05 | 0.24 | 2.89 | 0.040 | 0.79 | 7.48 |
| | | | 240 | 3.46 | 0.49 | 19.40 | 41.05 | 7.03 | 1.91 | 0.22 | 4.62 | 0.038 | 1.15 | 7.98 |
| 7 | 75 | 40 | 10 | 3.53 | 0.83 | 17.76 | 45.08 | 6.85 | 1.62 | 0.23 | 1.67 | 0.031 | 0.95 | 15.50 |
| | | | 240 | 3.72 | 0.66 | 20.81 | 41.86 | 7.07 | 1.80 | 0.07 | 1.64 | 0.033 | 1.89 | 10.65 |
| 8 | 90 | 5 | 10 | 4.19 | 13.17 | 15.50 | 38.07 | 6.22 | 1.69 | 0.57 | 2.88 | 0.042 | 1.50 | 12.28 |
| | | | 240 | 3.48 | 1.95 | 24.20 | 31.28 | 9.73 | 2.52 | 0.50 | 3.61 | 0.105 | 2.45 | 17.12 |
| 9 | 90 | 15 | 10 | 3.67 | 3.87 | 15.27 | 36.62 | 6.39 | 1.63 | 0.33 | 2.81 | 0.072 | 0.84 | 16.50 |
| | | | 240 | 3.29 | 0.35 | 18.56 | 37.77 | 7.00 | 1.60 | 0.23 | 4.22 | 0.087 | 0.64 | 20.38 |
| 10 | 90 | 40 | 10 | 3.65 | 1.01 | 19.21 | 41.84 | 6.11 | 2.39 | 0.16 | 1.75 | 0.016 | 2.92 | 15.15 |
| | | | 30 | 3.71 | 0.91 | 18.51 | 38.34 | 6.76 | 1.72 | 0.13 | 1.39 | 0.047 | 0.51 | 18.68 |
| | | | 60 | 3.62 | 0.87 | 19.24 | 38.54 | 6.88 | 1.58 | 0.10 | 1.38 | 0.046 | 1.65 | 15.97 |
| | | | 240 | 3.58 | 0.95 | 22.41 | 41.77 | 7.25 | 2.32 | 0.08 | 1.73 | 0.024 | 1.12 | 12.85 |

[1]Westmoreland coal, Absaloka Mine.

TABLE 5

HF Leach Tests, Final Solution Analyses
Powder River Basin Coal, Absaloka Mine

| Test No. | Temp °C. | HF Acid Conc, % | Solids % | Analyses, g/l Si | Al | Ti | K | Na | P[1] |
|---|---|---|---|---|---|---|---|---|---|
| 1 | 30 | 5 | 10 | 0.61 | 0.274 | 0.0149 | 0.005 | 0.099 | 0.00001 |
| 2 | 30 | 15 | 10 | 0.86 | 0.250 | 0.0222 | 0.008 | 0.132 | 0.00003 |
| 3 | 30 | 40 | 10 | 1.80 | 0.240 | 0.0258 | 0.011 | 0.263 | 0.00002 |
| 4 | 30 | 70 | 10 | 2.11 | 0.275 | 0.0257 | 0.011 | 0.281 | 0.00004 |
| 5 | 75 | 5 | 10 | 0.71 | 0.261 | 0.0226 | 0.007 | 0.102 | — |
| 6 | 75 | 15 | 10 | 0.97 | 0.254 | 0.0275 | 0.009 | 0.122 | — |
| 7 | 75 | 40 | 10 | 1.77 | 0.197 | 0.0332 | 0.011 | 0.245 | — |
| 8 | 90 | 5 | 10 | 0.77 | 0.270 | 0.0255 | 0.008 | 0.094 | — |
| 9 | 90 | 15 | 10 | 1.00 | 0.256 | 0.0317 | 0.010 | 0.161 | — |
| 10 | 90 | 40 | 10 | 1.53 | 0.190 | 0.0335 | 0.012 | 0.249 | — |

[1]Samples from Tests 5 through 10 not analyzed for phosphorus.

EXAMPLE 4

Tests were devised to determine the effect of temperature, HCl concentration and time on the removal of ash from coal preleached in HF. The coal used for these tests was 20- by 100-mesh cleaned coal composite described in Example 1. To produce the feed for the HCl tests, the coal was preleached in HF; conditions for this two-stage HF leach are described in Example 1.

The samples were all processed through the various HCl leaches in the following manner. A split of the moist, HF preleached coal weighing 280 grams (wet weight) was mixed with sufficient HCl solution to form a 10% solids slurry. The slurry was agitated at a constant temperature and solid samples were removed by means of a 100-mesh brass screen dipper at time intervals of 10, 30, 60, and 240 minutes. After rinsing the samples on a brass 100-mesh screen with deionized water, they were placed into the washing apparatus described in the HF Leach Test section and washed for two hours. Washed samples were drained and baked at 300° C. for two hours in a nitrogen atmosphere. The samples were each analyzed for ash content and were also analyzed by ICPES to determine the composition. Test results are given in Tables 6 and 7.

TABLE 6

Aqueous HCl Leaching Conditions and Results (10% solids in suspension)

| Test No. | Temp °C. | Acid Conc % | Time min | Dry Ash, % | Percent in Ash $SiO_2$ | $Al_2O_3$ | CaO | MgO |
|---|---|---|---|---|---|---|---|---|
| HF pre-leached feed | — | | | 3.14 | 1.15 | 17.43 | 42.48 | 6.74 |
| 11 | 30 | 3 | 10 | 2.07 | 1.43 | 13.09 | 30.17 | 7.27 |
| | | | 30 | 1.53 | 0.85 | 11.32 | 29.67 | 6.89 |
| | | | 60 | 1.40 | 1.21 | 10.48 | 30.88 | 6.67 |
| 12 | 30 | 10 | 10 | 1.67 | 0.70 | 11.94 | 26.56 | 7.95 |
| | | | 30 | 1.37 | 0.95 | 10.47 | 23.56 | 7.15 |
| | | | 60 | 1.05 | 1.10 | 8.64 | 22.03 | 6.23 |
| | | | 240 | 0.65 | 1.72 | 6.29 | 25.95 | 3.20 |
| 13 | 30 | 20 | 10 | 1.52 | 1.04 | 14.48 | 28.16 | 9.73 |
| | | | 30 | 1.29 | 0.94 | 11.39 | 23.85 | 8.63 |
| | | | 60 | 1.01 | 1.08 | 11.15 | 25.49 | 8.34 |
| 14 | 30 | 32 | 60 | 1.19 | 2.47 | 13.48 | 22.83 | 9.49 |
| 15 | 75 | 3 | 10 | 1.10 | 1.33 | 11.21 | 29.02 | 6.45 |
| | | | 30 | 0.72 | 2.00 | 8.30 | 30.15 | 4.21 |
| | | | 60 | 0.64 | 1.17 | 8.21 | 29.05 | 4.18 |
| 16 | 75 | 10 | 10 | 0.61 | 1.37 | 9.67 | 22.62 | 5.57 |
| | | | 30 | 0.39 | 1.80 | 8.39 | 29.18 | 4.40 |
| | | | 60 | 0.35 | 1.63 | 6.79 | 25.73 | 3.79 |
| 17 | 75 | 20 | 10 | 0.97 | 1.36 | 9.99 | 25.11 | 6.73 |
| | | | 30 | 0.54 | 1.42 | 8.95 | 26.94 | 4.92 |
| | | | 60 | 0.58 | 1.74 | 8.57 | 29.64 | 4.64 |
| 18 | 60 | 32 | 60 | 0.65 | 1.33 | 10.29 | 22.17 | 6.81 |
| 19 | 90 | 3 | 10 | 0.90 | 1.22 | 10.97 | 28.05 | 6.35 |
| | | | 30 | 0.15 | 1.25 | 7.86 | 28.74 | 4.15 |
| | | | 60 | 0.37 | 6.27 | 7.95 | 26.80 | 3.42 |
| 20 | 90 | 10 | 10 | 0.24 | 1.34 | 9.30 | 28.87 | 5.24 |
| | | | 30 | 0.15 | 1.73 | 7.35 | 25.91 | 4.11 |
| | | | 60 | 0.15 | 1.51 | 6.52 | 23.99 | 4.03 |
| 21 | 90 | 20 | 10 | 0.47 | 1.24 | 9.73 | 26.92 | 5.72 |
| | | | 30 | 0.27 | 3.86 | 9.33 | 25.55 | 5.00 |
| | | | 60 | 0.20 | 3.57 | 8.40 | 23.06 | 4.62 |

TABLE 6-continued

Aqueous HCl Leaching Conditions and Results (10% solids in suspension)

| Test No. | Temp °C. | Acid Conc % | Time min | Percent In Ash $Fe_2O_3$ | $TiO_2$ | $Na_2O$ | $K_2O$ | $SO_3$ |
|---|---|---|---|---|---|---|---|---|
| HF pre-leached feed | — | — | — | 3.83 | 0.12 | 1.39 | 0.031 | 10.20 |
| 11 | 30 | 3 | 10 | 2.22 | 0.17 | 2.07 | 0.007 | — |
| | | | 30 | 3.17 | 0.20 | 1.66 | 0.008 | 32.4 |
| | | | 60 | 3.19 | 0.28 | 1.44 | 0.012 | — |
| 12 | 30 | 10 | 10 | 2.55 | 0.17 | 1.88 | 0.014 | 33.7 |
| | | | 30 | 3.15 | 0.19 | 1.76 | 0.024 | — |
| | | | 60 | 4.10 | 0.30 | 1.23 | 0.012 | — |
| | | | 240 | 8.18 | 0.50 | 0.51 | 0.007 | 43.2 |
| 13 | 30 | 20 | 10 | 2.67 | 0.21 | 2.47 | 0.007 | 21.1 |
| | | | 30 | 3.12 | 0.23 | 1.95 | 0.007 | 40.2 |
| | | | 60 | 4.27 | 0.27 | 2.02 | 0.023 | 43.9 |
| 14 | 30 | 32 | 60 | 3.86 | 0.38 | 2.57 | 0.023 | 37.9 |
| 15 | 75 | 3 | 10 | 4.72 | 0.37 | 1.36 | 0.022 | 42.9 |
| | | | 30 | 7.61 | 0.61 | 0.52 | 0.011 | — |
| | | | 60 | 7.96 | 0.73 | 0.61 | 0.029 | — |
| 16 | 75 | 10 | 10 | 8.00 | 0.52 | 1.08 | 0.039 | — |
| | | | 30 | 11.11 | 1.02 | 0.45 | 0.014 | — |
| | | | 60 | 11.21 | 0.98 | 0.56 | 0.024 | — |
| 17 | 75 | 20 | 10 | 5.66 | 0.45 | 1.52 | 0.015 | 43.9 |
| | | | 30 | 12.73 | 0.90 | 0.62 | 0.031 | 40.4 |
| | | | 60 | 14.99 | 1.25 | 0.24 | 0.013 | — |
| 18 | 60 | 32 | 60 | 7.62 | 0.69 | 1.60 | 0.015 | 41.4 |
| 19 | 90 | 3 | 10 | 5.48 | 0.49 | 1.38 | 0.015 | 41.2 |
| | | | 30 | 7.97 | 0.84 | 0.64 | 0.037 | 41.7 |
| | | | 60 | 9.49 | 0.89 | 0.79 | 0.047 | 36.4 |
| 20 | 90 | 10 | 10 | 8.67 | 0.70 | 1.01 | 0.015 | — |
| | | | 30 | 12.83 | 1.00 | 0.92 | 0.022 | — |
| | | | 60 | 15.37 | 1.14 | 0.20 | 0.014 | — |
| 21 | 90 | 20 | 10 | 10.78 | 0.84 | 0.97 | 0.067 | 37.9 |
| | | | 30 | 16.97 | 1.33 | 0.003 | 0.030 | — |
| | | | 60 | 17.87 | 1.41 | 0.095 | 0.028 | — |

TABLE 7

HCl Leach Test, Final Solution Analyses Powder River Basin Coal

| Test No. | Temp °C. | HCl Acid Conc, % | Solids % | Analyses, g/l Si | Al | Ca | Mg | Fe | Ti | Na | K | P | F |
|---|---|---|---|---|---|---|---|---|---|---|---|---|---|
| 11 | 30 | 3 | 10 | 0.02 | 0.249 | 0.798 | 0.082 | 0.004 | 0.00051 | 0.028 | 0.001 | 0.00062 | 1.66 |
| 12 | 30 | 10 | 10 | 0.02 | 0.284 | 0.903 | 0.110 | 0.005 | 0.00066 | 0.036 | 0.001 | 0.00077 | 1.96 |
| 13 | 30 | 20 | 10 | 0.01 | 0.270 | 0.956 | 0.099 | 0.001 | 0.00071 | 0.031 | 0.001 | 0.00069 | 1.96 |
| 15 | 75 | 3 | 10 | 0.03 | 0.276 | 0.851 | 0.112 | 0.006 | 0.00056 | 0.039 | 0.001 | 0.00058 | 1.98 |
| 16 | 75 | 10 | 10 | 0.02 | 0.313 | 1.02 | 0.141 | 0.007 | 0.00043 | 0.045 | 0.001 | 0.00065 | 2.17 |
| 17 | 75 | 20 | 10 | 0.02 | 0.318 | 1.11 | 0.144 | 0.001 | 0.00052 | 0.044 | 0.001 | 0.00069 | 2.26 |
| 19 | 90 | 3 | 10 | 0.04 | 0.359 | 1.13 | 0.151 | 0.010 | 0.00102 | 0.051 | 0.001 | 0.00096 | 2.49 |
| 20 | 90 | 10 | 10 | 0.02 | 0.367 | 1.18 | 0.159 | 0.008 | 0.00051 | 0.050 | 0.001 | 0.00073 | 2.34 |
| 21 | 90 | 20 | 10 | 0.02 | 0.367 | 1.25 | 0.171 | 0.002 | 0.00040 | 0.050 | 0.001 | 0.00077 | 2.30 |

EXAMPLE 5

Tests were conducted on coal which had been leached under differing conditions to determine the effect which washing, under varying circumstances, and additives mixed with the wash water had on the final product.

After contacting coal with hydrochloric and hydrofluoric acids to remove mineral matter the coal was washed to remove dissolved cations and anions according to the following methods.

Coal which had been aggressively leached with two stages of HF, one stage of HCl and rinsed, was washed for eight hours. Solids concentrations of 20, 30 and 40% respectively were evaluated. For each percent solids tested washing was done by pairs. One member of the pair was agitated by air entrainment for two hours, a solid/liquid separation made, and new deionized water added for a second two hour agitation period, and the process repeated for two hours for a total of four, two hour periods (A Samples). The other member of each pair was agitated by air entrainment for eight hours then the solids were separated from the wash liquors (B samples). The solids analyses are given in Table 8; solution analyses in Table 9.

TABLE 8

Leached Coal Product Washing Tests, Solids Analyses

| Test No. | Washing Conditions[1] Time, hr | Solids, % | Dry Ash % | Cl % | F % | $Al_2O_3$ % | MgO % | CaO % |
|---|---|---|---|---|---|---|---|---|
| Raw Coal[2] | — | — | 12.33 | 0.001 | 0.006 | 21.37 | 1.52 | 19.86 |
| Leached Product[3] | — | — | 0.31 | 0.673 | 0.109 | 12.74 | 8.64 | 32.03 |
| 1-A | 8 | 20 | 0.31 | 0.302 | 0.072 | 7.52 | 3.87 | 27.66 |
| 1-B | 8 | 20 | 0.32 | 0.461 | 0.090 | 7.89 | 4.44 | 27.16 |
| 2-A | 8 | 30 | 0.30 | 0.338 | 0.080 | 9.87 | 3.84 | 27.29 |
| 2-B | 8 | 30 | 0.31 | 0.516 | 0.091 | 8.21 | 4.77 | 26.26 |
| 3-A | 8 | 40 | 0.31 | 0.420 | 0.073 | 8.51 | 3.63 | 24.94 |
| 3-B | 8 | 40 | 0.34 | 0.582 | 0.088 | 9.03 | 5.26 | 25.53 |

[1]Ambient temperature, suspension by air entrainment (Pachuca vessels).
[2]Raw Powder River Basin (Absaloka Mine) coal, 28-mesh by zero.
[3]3-stage batch leach:
a. Cleaned 20- by 100-mesh Powder River Basin (Absaloka Mine) coal.
b. HF leach stage 1, 70% HF, room temperature, 1 hour mechanical stirring, 400 ml acid and 700 g coal.
c. HF leach stage 2, coal from stage 1 plus 370 ml of 38% HF, 90–100° C., 1 hour, mechanical stirring.
d. HCl leach, coal from HF leach stage 2 plus 320 ml of 20% HCl, 90–100° C., 1 hour.
e. Coal from HCl leach drained free of acid and rinsed in DI water.

TABLE 9

Leached Coal Product Washing Tests, Solution Analyses

| Test No. | Sampling Time, hr | Solids % | Solution Analyses, g/l Al | Mg | Ca | Na | Cl | F |
|---|---|---|---|---|---|---|---|---|
| 1-A | 2 | 20 | 0.021 | 0.015 | 0.018 | 0.005 | 0.536 | 0.039 |
| | 4 | 20 | 0.008 | 0.003 | 0.005 | 0.002 | 0.270 | 0.013 |
| | 6 | 20 | 0.005 | 0.001 | 0.002 | 0.002 | 0.180 | 0.006 |
| | 8 | 20 | 0.005 | 0.001 | 0.002 | 0.001 | 0.132 | 0.003 |
| 1-B | 8 | 20 | 0.017 | 0.015 | 0.020 | 0.005 | 0.478 | 0.042 |
| 2-A | 1 | 30 | 0.028 | 0.026 | 0.030 | 0.009 | 0.650 | 0.063 |
| | 2 | 30 | 0.013 | 0.008 | 0.011 | 0.004 | 0.410 | 0.025 |
| | 4 | 30 | 0.008 | 0.003 | 0.006 | 0.004 | 0.324 | 0.014 |
| | 8 | 30 | 0.007 | 0.001 | 0.004 | 0.002 | 0.266 | 0.010 |
| 2-B | 8 | 30 | 0.028 | 0.026 | 0.041 | 0.008 | 0.612 | 0.061 |
| 3-A | 1 | 40 | 0.033 | 0.039 | 0.046 | 0.012 | 0.790 | 0.088 |
| | 2 | 40 | 0.018 | 0.017 | 0.022 | 0.007 | 0.586 | 0.050 |
| | 4 | 40 | 0.011 | 0.008 | 0.012 | 0.004 | 0.466 | 0.028 |
| | 8 | 40 | 0.005 | 0.004 | 0.008 | 0.005 | 0.376 | 0.020 |
| 3-B | 8 | 40 | 0.038 | 0.040 | 0.047 | 0.012 | 0.770 | 0.091 |

EXAMPLE 6

Coal leached under more moderate conditions was washed by slurrying the coal mechanically with various wash solutions. Initial work was with a coal which was leached in the presence of an oxidant (sodium chlorate). The use of ammonium hydroxide produced a startling improvement over ordinary deionized water, see Table 10, but residual halogen levels were still too high.

Tests were conducted with coal leached under moderate conditions when no oxidant was added. The effects of temperature, time, additive, and concentration are assessed in two test series. Results are reported in Tables 11 and 12.

To determine if either the removal of chloride or fluoride were being inhibited by the presence of these ions in solution, an equilibrium test was made. Conditions and results are in Table 13.

TABLE 10

Effect of Ammonium Hydroxide for Removing Halogens

| Test No. | Sample | Wash[2] Solution | Dry Solids Ash % | Chlorine % | $NH_3$ ppm |
|---|---|---|---|---|---|
| — | Feed to wash (leached coal product) | | 0.22 | 1.35 | — |
| 211 | Washed product | DI water | 0.20 | 1.08 | 60 |
| 212 | Washed product | $NH_4OH$ | 0.19 | 0.44 | 10,500 |

[1]Leached coal product material from the batch pilot plant, sample BP-1, WC-1, see Example 7.
[2]Conditions were 0.3% solids, 19 hours, ambient temperature (20°–30° C.), suspension by stirring.

TABLE 11

Wash Tests Results, 1st Series
(Powder River Basin Coal, Absaloka Mine)

| Test No. | Wash Conditions[1] Reagent | Temp °C. | Filtrate Chloride ppm | Washed Solids Sulfur % | Chloride ppm | Fluoride ppm |
|---|---|---|---|---|---|---|
| 220 | Feed to wash (leached coal product)[3] | | — | 1.16 | 6815 | 142 |
| 221 | Water | Ambient[2] | 45 | 1.18 | 760 | |
| 226 | Water | 60 | 47 | 1.01 | 590 | 172 |
| 222 | 0.1% $NH_4OH$ | Ambient | 48.5 | 0.93 | 650 | 107 |
| 227 | 0.1% $NH_4OH$ | 60 | 50 | 0.86 | 540 | 214 |
| 223 | 5% $NH_4OH$ | Ambient | 51 | 0.87 | 530 | 163 |
| 228 | 5% $NH_4OH$ | 60 | 51 | 0.90 | 430 | 158 |
| 224 | 0.1% $CH_3COOH$ | Ambient | 46.5 | — | 720 | 132 |
| 229 | 0.1% $CH_3COOH$ | 60 | — | — | 550 | 223 |
| 225 | 5% $CH_3COOH$ | Ambient | 48 | — | 590 | 127 |
| 230 | 5% $CH_3COOH$ | 60 | 49 | — | 530 | 255 |

TABLE 11-continued

| Wash Tests Results, 1st Series (Powder River Basin Coal, Absaloka Mine) | | | | | | |
|---|---|---|---|---|---|---|
| | Wash Conditions[1] | | Filtrate | Washed Solids | | |
| Test No. | Reagent | Temp °C. | Chloride ppm | Sulfur % | Chloride ppm | Fluoride ppm |
| 231 | 5% Alcohol[4] | 60 | 48 | 0.95 | 470 | 127 |

[1]Time: 18 hours, 1% solids, suspension by stirring
[2]Ambient temp = 20–23° C.
[3]3-Stage batch leach:
a. Raw Powder River Basin (Absaloka Mine) coal, 28-Mesh by zero.
b. 10% HCl, 10% solids, ambient temperature, 4 hr, 5 displacement washes, DI water.
c. 20% HF, 10% solids, ambient temperature, 4 hr, 5 displacement washes and one long-term wash, DI water.
d. 10% HCl, 10% solids, 90° C., 1 hr, 2 reslurry washes, DI water.
[4]90.25% ethanol, 4.75% methanol, 5.00% isopropanol (by volume).

TABLE 12

| Wash Tests Results, 2nd Series (Powder River Basin Coal, Absaloka Mine) | | | | | | | | |
|---|---|---|---|---|---|---|---|---|
| | | | Filtrate | | | | | |
| | Wash Conditions[1] | | | Half-time | | Final | Washed Solids | |
| Test No. | Reagent | Temp °C. | Time hr | Time hr | Cl ppm | Cl ppm | Chloride ppm | Fluoride ppm |
| 220 | Feed to wash (leached coal product)[3] | | — | — | — | — | 6815 | 142 |
| 300 | Water | Ambient[2] | 1 | ½ | 46 | 49 | 674 | 146 |
| 314 | Water | Ambient | 4 | 2 | 43 | 47 | 694 | 121 |
| 328 | Water | Ambient | 18 | 9 | 50 | 46 | 555 | 202 |
| 335 | Water | 90 | 1 | ½ | 30 | 45 | 477 | 93 |
| 321 | Water | 90 | 4 | 2 | 51 | 50 | 377 | 301 |
| 307 | Water | 90 | 18 | 9 | 52 | 47 | 351 | 475 |
| 305 | 0.1% $NH_4OH$ | Ambient | 1 | ½ | 46 | 45 | 436 | 86 |
| 319 | 0.1% $NH_4OH$ | Ambient | 4 | 2 | 51 | 47 | 420 | 78 |
| 333 | 0.1% $NH_4OH$ | Ambient | 18 | 9 | 48 | 53 | 338 | 138 |
| 340 | 0.1% $NH_4OH$ | 90 | 1 | ½ | 42 | 54 | 391 | 59 |
| 326 | 0.1% $NH_4OH$ | 90 | 4 | 2 | 50 | 46 | 287 | 117 |
| 312 | 0.1% $NH_4OH$ | 90 | 18 | 9 | 56 | 53 | 341 | 181 |
| 306 | 10% $NH_4OH$ | Ambient | 1 | ½ | 50 | 46 | 325 | 51 |
| 320 | 10% $NH_4OH$ | Ambient | 4 | 2 | 55 | 47 | 390 | 51 |
| 334 | 10% $NH_4OH$ | Ambient | 18 | 9 | 53 | 51 | 287 | 118 |
| 341 | 10% $NH_4OH$ | 90 | 1 | ½ | 48 | 54 | 403 | 46 |
| 327 | 10% $NH_4OH$ | 90 | 4 | 2 | 52 | 54 | 309 | 32 |
| 313 | 10% $NH_4OH$ | 90 | 18 | 9 | 59 | 50 | 207 | 257 |
| 303 | 0.1% $CH_3COOH$ | Ambient[2] | 1 | ½ | 44 | 46 | 646 | 113 |
| 317 | 0.1% $CH_3COOH$ | Ambient | 4 | 2 | 48 | 46 | 629 | 121 |
| 331 | 0.1% $CH_3COOH$ | Ambient | 18 | 9 | 49 | 50 | 654 | 119 |
| 338 | 0.1% $CH_3COOH$ | 90 | 1 | ½ | 36 | 47 | 504 | 90 |
| 324 | 0.1% $CH_3COOH$ | 90 | 4 | 2 | 48 | 50 | 432 | 90 |
| 310 | 0.1% $CH_3COOH$ | 90 | 18 | 9 | 52 | 54 | 323 | 113 |
| 304 | 10% $CH_3COOH$ | Ambient | 1 | ½ | 48 | 36 | 562 | 119 |
| 318 | 10% $CH_3COOH$ | Ambient | 4 | 2 | 48 | 44 | 495 | 104 |
| 332 | 10% $CH_3COOH$ | Ambient | 18 | 9 | 50 | 51 | 461 | 100 |
| 339 | 10% $CH_3COOH$ | 90 | 1 | ½ | 36 | 48 | 437 | 81 |
| 325 | 10% $CH_3COOH$ | 90 | 4 | 2 | 51 | 47 | 357 | 55 |
| 311 | 10% $CH_3COOH$ | 90 | 18 | 9 | 51 | 50 | 321 | 55 |
| 301 | 0.1% Alcohol[4] | Ambient | 1 | ½ | 46 | 44 | 671 | 127 |
| 315 | 0.1% Alcohol | Ambient | 4 | 2 | 44 | 45 | 643 | 144 |
| 329 | 0.1% Alcohol | Ambient | 18 | 9 | 48 | 48 | 626 | 130 |
| 336 | 0.1% Alcohol | 90 | 1 | ½ | 33 | 48 | 503 | 97 |
| 322 | 0.1% Alcohol | 90 | 4 | 2 | 48 | 52 | 352 | 137 |
| 308 | 0.1% Alcohol | 90 | 18 | 9 | 47 | 45 | 315 | 125 |
| 302 | 10% Alcohol | Ambient | 1 | ½ | 44 | 45 | 662 | 141 |
| 316 | 10% Alcohol | Ambient | 4 | 2 | 46 | 45 | 597 | 129 |
| 330 | 10% Alcohol | Ambient | 18 | 9 | 49 | 50 | 558 | 174 |
| 337 | 10% Alcohol | 90 | 1 | ½ | 34 | 48 | 490 | 99 |
| 323 | 10% Alcohol | 90 | 4 | 2 | 47 | 51 | 384 | 85 |
| 309 | 10% Alcohol | 90 | 18 | 9 | 52 | 52 | 319 | 108 |

[1]1% solids, suspension by stirring.
[2]Ambient temp = 20–23° C.
[3]3-stage leach:
a. Raw Powder River Basin (Absaloka Mine) coal, 28-Mesh by zero.
b. 10% HCL, 80° C., 1 hr, 5 displacement washes, DI water.
c. 20% HF, ambient temperature, 4 hr, 5 displacement washes and 1 long-term wash, DI water.
d. 10% HCL, 90° C., 1 hr, 2 reslurry washes, DI water.
[4]Alcohol = 90.25% ethanol, 4.75% methanol, 5.00% isopropanol (by volume).

TABLE 13

Equilibrium Wash Test Results
(Powder River Basin Coal, Absaloka Mine)

| Test | Conditions[1] Wash 1, Time, hr | Wash 2, Time, hr | Wash 3, Time, hr | Filtrate $Cl^-$ Conc, ppm Wash 1 | Wash 2 | Wash 3 | Solids Analysis Cl, ppm | F, ppm |
|---|---|---|---|---|---|---|---|---|
| 220 | Feed to wash (leached coal product)[2] | | | | | | 6815 | 142 |
| 251 | 2 | 0 | 0 | 53.5 | — | — | 330 | 110 |
| 252 | 2 | 2 | 0 | 53.3 | 0.1 | — | 333 | 56 |
| 253 | 2 | 2 | 2 | 53.7 | 0.0 | 0.0 | 361 | 47 |

[1]90° C., 1% solids, suspension by stirring.
[2]3-stage batch leach:
a. Raw Powder River Basin (Absaloka Mine) coal, 28-Mesh by zero.
b. 10% HCl, 10% solids, 80° C., 1 hr, 5 displacement washes, DI water.
c. 20% HF, 10% solids, ambient temperature, 4 hr, 5 displacement washes and one long-term wash, DI water.
d. 10% HCl, 10% solids, 90° C., 1 hr, 2 reslurry washes, DI water.

EXAMPLE 7

A random sample of 2-inch by zero Absaloka Mine coal was prepared for use in a batch pilot plant. The coal was crushed to a 28-mesh (Tyler) top size, and wet-processed on a laboratory-size Deister Table. No attempt was made to maximize Btu recovery or reduce coal loss, only to produce a clean coal product.

One 22.5 pound batch of this clean coal composite represented the feed to the pilot plant and was further processed as follows:

HF Leach: Single stage, 20% HF, 10% solids, ambient temperature (17°–34° C.), 4 hours.

HCl Leach: Single stage, 10% HCl, 10% solids, 90° C., 1 hour. Sodium chloride oxidant added at beginning of leach to an emf of −925 mv (approximately 0.06 lb $NaClO_3$/lb dry coal).

Long term (elutriation) wash: 20 gph deionized water, 24 hours.

Drying: 66° C., approximately 15 hours, nitrogen purge.

Baking: 230° C., approximately 26 hours, nitrogen purge.

Analyses of the raw coal (feed to the table), tabled coal (feed to the leaching sequence) and product are given in Table 14. Table 15 contains ash values of intermediate products.

TABLE 14

Batch Pilot Plant Feed and Product
Summary of Analyses, Westmoreland Coal, Absaloka Mine

| Analyses | Raw Coal (feed to table) | Tabled Coal (feed to process) | Leached Coal Product |
|---|---|---|---|
| Weight, % (DB) | 100 | 51.1 | — |
| Coal Analyses: | | | |
| Moisture (AR), % | 20.32 | 12.94 | 0.22 |
| Ash (DB), % | 14.30 | 8.47 | 0.16 |
| Sulfur (DB) | | | |
| Total, % | 0.97 | 0.61 | 0.56 |
| Pyritic, % | 0.53 | 0.13 | 0.07 |
| Organic, % | 0.40 | 0.46 | 0.49 |
| Sulfate, % | 0.04 | 0.02 | 0.01 |
| Btu, lb (DB) | 11,177 | 11,821 | 12,780 |
| Chloride (AR), % | — | 0.001 | 0.501 |
| Fluoride (AR), % | — | 0.005 | 0.022 |
| Ash Analyses, % as Oxides: | | | |
| $SiO_2$ | 35.75 | 30.92 | 6.09 |
| $Al_2O_3$ | 15.90 | 18.56 | 6.78 |
| CaO | 21.12 | 25.56 | 19.71 |
| MgO | 2.22 | 3.38 | 2.83 |
| $Fe_2O_3$ | 5.45 | 3.05 | 31.00 |
| $TiO_2$ | 0.72 | 0.90 | 5.51 |
| $Na_2O$ | 3.07 | 4.64 | 0.32 |
| $K_2O$ | 0.488 | 0.16 | 0.07 |

TABLE 14-continued

Batch Pilot Plant Feed and Product
Summary of Analyses, Westmoreland Coal, Absaloka Mine

| Analyses | Raw Coal (feed to table) | Tabled Coal (feed to process) | Leached Coal Product |
|---|---|---|---|
| $P_2O_5$ | 0.72 | 1.75 | 2.00 |
| $SO_3$ | 12.91 | 12.31 | 27.65 |

Note:
AR = as-received
DB = dry basis

TABLE 15

Batch Pilot Plant Intermediate Products
Ash Analyses, Westmoreland Coal, Absaloka Mine

| Feed or Product | Ash % Dry Basis |
|---|---|
| Feed coal, minus 28-mesh | 14.30 |
| Clean coal composite | 8.47 |
| HF leach product | 4.03 |
| HCl leach product | 0.22 |
| Washed product | 0.17 |
| Leached coal product | 0.16 |

EXAMPLE 8

Pre-Leach with HCl

Many Western coals contain high levels of calcium. In hydrofluoric acid leaching of these coals, less than 30% of the calcium is removed due to the insolubility of calcium fluoride in HF. The remaining unleached calcium leaves the HF leaching circuit, as solid $CaF_2$, and constitutes a loss of fluorine values. To preclude the loss of fluorine as insoluble $CaF_2$, a hydrochloric acid leach was proposed *prior* to the HF leach. The effect of an HCl preleach under the test conditions is given in Table 16. The effect of the HCl pre-leach under varying conditions of time, temperature, HCl concentration and percent solids was also studied. One series of tests was performed at elevated temperatures, ranging from 30° C. to 90° C. and general test procedure for these tests was as follows.

The slurry was heated to the desired temperature and agitated. During this leach period, small additions of saturated sodium chlorate (80% solution) were added to some tests as a means of assessing its usefulness in removing pyritic sulfur.

After each HCl preleach, the slurry was filtered and washed. In Test, No. 201, the slurry was filtered on a polypropylene Buchner funnel and the filter cake was washed with one liter of deionized (DI) water. The resulting filtrate was checked for chloride content by potentiometric titration using a specific ion electrode. The filter cake was then reslurried with a fresh liter of DI water and filtered on the same apparatus. Again, the filtrate was analyzed for chloride. A series of 11 more 1-liter washes of the solids on the filter followed. Each filtrate was analyzed for chloride. The removal of chloride from the leached coal was essentially complete after 10 washes, as indicated by lower chloride concentrations in the filtrates.

Leached coals in subsequent tests (202–208 and 213) were washed using one 1-liter reslurry followed by nine 1-liter washes on the filter.

Following the washings a 300 gm. portion of the HCL pre-leached product was subjected to an HF acid leach under the following conditions.

20% HF concentration
10% Solids
Ambient temperature (20°–23° C.)
4 Hours
Constant agitation The resulting solids were washed in a manner similar to that used after the HCl preleach.

Products from both the HCl preleach and HF leach were analyzed and results are given in Table 17.

In another series of HCl pre-leach tests, higher solids concentrations and longer times were examined at ambient temperature. No oxidant was used and no HF Leach followed the HCl preleach in these tests, but test procedure was otherwise the same as the method earlier described.

Results of this test series are given in Table 18.

TABLE 16

Effect of HCl for Removing Elements Prior to HF Leaching

CONDITIONS

Feed: 50 gm. 28-mesh by zero raw coal, Absaloka Mine
Leach: 10% solids
60° C.
5% HCl
2 hours
440 ml. of filtrate

RESULTS

| Constituent | Percent in Feed Coal | Filtrate g/l | Feed Coal g | Filtrate g | Extraction % |
|---|---|---|---|---|---|
| Ash % | 14.3 | | 5.70 | 2.35[1] | 41.2 |
| Calcium | 1.72 | 1.79 | 0.860 | 0.788 | 91.6 |
| Magnesium | 0.15 | 0.128 | 0.075 | 0.056 | 74.6 |
| Aluminum | 0.96 | 0.117 | 0.480 | 0.051 | 10.6 |
| Potassium | 0.046 | 0.006 | 0.023 | 0.003 | 13.0 |
| Sodium | 0.26 | 0.292 | 0.130 | 0.128 | 98.5 |
| Leached Product, Ash % | 9.04 | | | | |

[1]Calculated from metals in filtrate by converting them to oxides and summing.

TABLE 17

HCl PRE-LEACH TEST CONDITIONS AND RESULTS
Pre-leach Followed by HF Leach
Powder River Basin Coal - Absaloka Mine

| Test No. | Leach[1] | HCl Leach Conditions Temp °C. | Acid Conc % | % Solids | Chlorate Added | Total Sulfur % | Pyritic Sulfur % | Heating Value Btu/lb | Cl % | F ppm | Dry Ash % | Percent in Ash $SiO_2$ | $Al_2O_3$ |
|---|---|---|---|---|---|---|---|---|---|---|---|---|---|
| Feed (28 m × 0 raw coal) | — | — | — | — | — | 1.03 | 0.58 | 11231 | 0.001 | 78 | 13.73 | 36.51 | 14.98 |
| 203 | HCl | 30 | 5 | 10 | Yes | 0.77 | 0.26 | 11404 | 0.314 | — | 10.87 | 60.98 | 25.03 |
| | HF[1] | — | — | — | — | 1.09 | 0.38 | — | 0.223 | 1298 | 1.13 | 4.73 | 3.61 |
| 207 | HCl | 30 | 10 | 10 | Yes | 1.04 | 0.44 | 11598 | 0.851 | — | 8.24 | 59.06 | 24.61 |
| | HF | — | — | — | — | 1.11 | 0.46 | — | 0.815 | 1000 | 1.13 | 5.87 | 8.79 |
| 213 | HCl | 30 | 20 | 10 | Yes | 0.74 | 0.40 | 10683 | 4.99 | — | 7.99 | 63.01 | 24.19 |
| | HF | — | — | — | — | 0.94 | 0.36 | — | 4.12 | — | 1.00 | 7.97 | 4.26 |
| 204 | HCl | 60 | 5 | 10 | Yes | 1.01 | 0.45 | 11305 | 2.22 | — | 8.36 | 55.71 | 22.62 |
| | HF | — | — | — | — | 1.07 | 0.45 | — | 1.84 | — | 1.00 | 4.22 | 1.97 |
| 205 | HCl | 60 | 5 | 10 | No | 1.06 | 0.47 | 11892 | 0.122 | — | 8.11 | 42.62 | 23.56 |
| | HF | — | — | — | — | 1.10 | 0.46 | — | 0.026 | 727 | 1.04 | 5.38 | 3.41 |
| 206 | HCl | 90 | 0.365 | 10 | Yes | 1.02 | 0.40 | 11734 | 0.074 | — | 9.10 | 39.73 | 23.48 |
| | HF | — | — | — | — | 1.11 | 0.42 | — | 0.044 | 2330 | 1.53 | 4.09 | 6.02 |
| 202 | HCl | 90 | 5 | 10 | Yes | 0.91 | 0.34 | 10639 | 5.23 | — | 7.38 | 62.91 | 24.51 |
| | HF | — | — | — | — | 0.98 | 0.35 | — | 4.28 | 500 | 0.95 | 9.69 | 5.08 |
| 201 | HCl | 90 | 10 | 10 | Yes | 0.69 | 0.25 | 10792 | 8.07 | — | 6.31 | 63.62 | 24.81 |
| | HF | — | — | — | — | 0.84 | 0.29 | — | 7.23 | 545 | 0.77 | 5.21 | 4.14 |
| 214 | HCl[2] | 90 | 10 | 10 | Yes | 0.58 | 0.23 | 10998 | 8.82 | 28 | 0.62 | 4.67 | 3.57 |
| 208 | HCl | 90 | 10 | 40 | Yes | 0.92 | 0.40 | 11257 | 1.90 | — | 7.40 | 54.53 | 23.66 |
| | HF | — | — | — | — | 1.07 | 0.44 | — | 1.38 | 921 | 1.07 | 4.43 | 3.02 |

| Test No. | Leach[2] | HCl Leach Conditions[3] Temp °C. | Acid Conc % | % Solids | Chlorate Added | Percent in Ash $Fe_2O_3$ | $TiO_2$ | $Na_2O$ | $K_2O$ | $P_2O_5$ | $SO_3$ |
|---|---|---|---|---|---|---|---|---|---|---|---|
| Feed (28 m × 0 raw coal) | | — | — | — | — | 6.35 | 0.71 | 3.37 | 0.50 | 1.33 | 11.45 |
| 203 | HCl | 30 | 5 | 10 | Yes | 4.89 | 0.99 | 0.089 | 1.05 | 0.15 | 0.65 |
| | HF[1] | — | — | — | — | 58.50 | 3.12 | 0.198 | 0.113 | 5.11 | 10.68 |
| 207 | HCL | 30 | 10 | 10 | Yes | 9.65 | 1.03 | 0.100 | 0.617 | 2.48 | 1.40 |
| | HF | — | — | — | — | 59.82 | 0.74 | 0.215 | 0.147 | 0.00 | 10.81 |
| 213 | HCl | 30 | 20 | 10 | Yes | 9.58 | 0.95 | 0.146 | 0.670 | 1.72 | 0.50 |
| | HF | — | — | — | — | 55.53 | 3.50 | 0.297 | 0.099 | 3.87 | 10.16 |
| 204 | HCl | 60 | 5 | 10 | Yes | 9.77 | 1.06 | 0.093 | 0.775 | 0.77 | 1.05 |
| | HF | — | — | — | — | 66.25 | 2.98 | 0.240 | 0.101 | 4.31 | 7.74 |
| 205 | HCl | 60 | 5 | 10 | No | 10.27 | 1.15 | 0.109 | 0.711 | 0.52 | 1.02 |
| | HF | — | — | — | — | 65.66 | 3.56 | 0.137 | 0.101 | 5.10 | 7.99 |
| 206 | HCl | 90 | 0.365 | 10 | Yes | 8.76 | 1.04 | 0.093 | 0.642 | 1.24 | 4.17 |
| | HF | — | | — | — | 42.38 | 2.13 | 0.166 | 0.065 | 4.78 | 19.76 |
| 202 | HCl | 90 | 5 | 10 | Yes | 9.14 | 1.08 | 0.098 | 0.664 | 0.29 | 0.72 |

TABLE 17-continued

HCl PRE-LEACH TEST CONDITIONS AND RESULTS
Pre-leach Followed by HF Leach
Powder River Basin Coal - Absaloka Mine

| | | | | | | | | | | | |
|---|---|---|---|---|---|---|---|---|---|---|---|
| | HF | — | — | — | — | 63.78 | 3.63 | 0.226 | 0.205 | 4.78 | 6.01 |
| 201 | HCl | 90 | 10 | 10 | Yes | 7.26 | 1.23 | 0.128 | 0.594 | 0.51 | 0.50 |
| | HF | — | — | — | — | 62.41 | 4.24 | 0.298 | 0.161 | 2.99 | 7.64 |
| 214 | HCl[2] | 90 | 10 | 10 | Yes | 68.06 | 4.53 | 0.245 | 0.029 | 2.81 | 9.23 |
| 208 | HCl | 90 | 10 | 40 | Yes | 9.07 | 1.22 | 0.127 | 0.691 | 1.55 | 0.64 |
| | HF | — | — | — | — | 69.79 | 3.36 | 0.197 | 0.041 | 2.72 | 8.98 |

[1]HF leach conditions for all tests: ambient temperature (20–23° C.), 20% HF, 10% solids, 4 hours.
[2]This HCl leach follows an HCl pre-leach and HF leach. Time for the post HCl test was 1 hour; feed was the leached solids from Test 201 (above).
[3]Leaching time for all HCl pre-leaches was one hour.
[4]Si, Al, Ca, Mg, Ti, Fe, and P by ICPES; NA and K by AA; $SO_3$ by Leco.

TABLE 18

HCl Pre-Leach Test Conditions and Results
Powder River Basin Coal
(Absaloka Mine)

| | HCl Leach Conditions[1] | | Dry | Percent in Ash[2] | | | |
|---|---|---|---|---|---|---|---|
| Test No. | % Solids | Time, hr | Ash, % | $SiO_2$ | $Al_2O_3$ | CaO | MgO |
| Feed | | | | | | | |
| 20 m × 0 | | | | | | | |
| Raw Coal | — | — | 13.73 | 36.51 | 14.98 | 22.81 | 2.36 |
| 232 | 10 | 1 | 7.82 | 56.06 | 23.96 | 1.68 | 0.89 |
| 233 | 10 | 2 | 7.05 | 55.57 | 24.07 | 1.71 | 0.89 |
| 234 | 10 | 4 | 8.49 | 55.59 | 22.58 | 1.18 | 0.95 |
| 235 | 40 | 1 | 8.99 | 54.42 | 23.20 | 1.54 | 0.93 |
| 236 | 40 | 2 | 9.03 | 55.14 | 23.02 | 1.20 | 0.93 |
| 237 | 40 | 4 | 8.53 | 54.00 | 22.02 | 1.41 | 0.90 |

| | HCl Leach Conditions[1] | | Percent in Ash[2] | | | | | |
|---|---|---|---|---|---|---|---|---|
| Test No. | % Solids | Time, hr | $Fe_2O_3$ | $TiO_2$ | $Na_2O$ | $K_2O$ | $P_2O_5$ | $SO_3$ |
| Feed | | | | | | | | |
| 20 m × 0 | | | | | | | | |
| Raw Coal | — | — | 6.35 | 0.71 | 3.37 | 0.50 | 1.33 | 11.45 |
| 232 | 10 | 1 | 8.64 | 1.23 | 0.177 | 0.773 | 1.97 | 0.50 |
| 233 | 10 | 2 | 8.13 | 1.30 | 0.177 | 0.653 | 1.91 | 0.50 |
| 234 | 10 | 4 | 9.11 | 1.50 | 0.342 | 0.864 | 1.54 | 0.50 |
| 235 | 40 | 1 | 8.93 | 1.21 | 0.124 | 0.887 | 1.51 | 0.50 |
| 236 | 40 | 2 | 8.06 | 1.51 | 0.147 | 0.881 | 1.63 | 0.50 |
| 237 | 40 | 4 | 8.31 | 1.43 | 0.171 | 0.893 | 1.34 | 0.50 |

[1]Ambient temperature, 20–23° C., and 10% HCl.
[2]Si, Al, Ca, Mg, Ti, Fe and P by ICPES: Na and K by AA, $SO_3$ by Leco.

EXAMPLE 9

Eastern Coal Leach Test

An Eastern bituminous coal from West Virginia was crushed to 28-mesh by zero and leached according to the sequence given below. After each leach, the solids were filtered and washed.

| Eastern Westmoreland Coal Leach Test Conditions[1] | | | | |
|---|---|---|---|---|
| % Solids | % HCl | % HF | Temp, °C. | Time, hr |
| 10 | 10 | — | Ambient[2] | 2 |
| 10 | — | 20 | Ambient | 4 |
| 10 | 10 | — | 80 | 1 |

[1]Five 900-ml DI water displacement washes after each leach.
[2]Ambient temperature (20° C.–30° C.).

Comparative results are given in Table 19.

TABLE 19

Eastern Bituminous Coal Leach Tests
Leached Coal Product Analyses

| Test No. | Raw Coal[1] | 1 | 2 | 3 |
|---|---|---|---|---|
| | Feed 28 M × 0 | 343- | | |
| Leach conditions[2] | | | | |
| Acid type | | HCL | HF | HCL |
| Acid conc | | 10 | 20 | 10 |
| Temp, °C. | | Ambient | Ambient | 90 |
| Time, hr | | 2 | 4 | 1 |
| Ash, % | 5.90 | 6.05 | 0.55 | 0.56 |
| Sulfur, % | | | | |
| Total | 0.76 | — | — | 0.80 |
| Sulfate | 0.01 | — | — | 0.01 |
| Pyritic | 0.10 | — | — | 0.14 |
| Heating Value, Btu/lb | 14355 | — | — | 15046 |
| Chloride, ppm | 1900 | — | — | 7140 |
| Fluoride, ppm | 86 | 105 | 9210 | 2500 |

TABLE 19-continued

Eastern Bituminous Coal Leach Tests
Ash Composition[3]

| % in Ash | Feed (28 M × 0 Raw Coal) | 343-3 Leached Coal Product |
|---|---|---|
| $SiO_2$ | 54.38 | 11.31 |
| $Al_2O_3$ | 30.39 | 16.82 |
| CaO | 1.88 | 9.92 |
| MgO | 1.06 | 2.23 |
| $Fe_2O_3$ | 6.27 | 30.36 |
| $TiO_2$ | 1.74 | 15.03 |
| $Na_2O$ | 0.632 | 1.12 |
| $K_2O$ | 0.802 | 0.727 |

TABLE 19-continued

| | | |
|---|---|---|
| $P_2O_5$ | 1.16 | 2.54 |
| $SO_3$ | 1.00 | 10.53 |

[1]Eastern Westmoreland Coal, HRI 24635.
[2]10% solids.
[3]Si, Al, Ca, Mg, Fe, Ti and P by ICPES, Na and K by AA; S by Leco

EXAMPLE 10

Pyrite and Other Mineral Matter Removal by Physical Processes

Although the chemical process for removing mineral matter from coal is quite effective as regards silicates and/or aluminosilicate minerals, as evidenced by the low $SiO_2$ and $Al_2O_3$ content of leached coal product, pyrite is not removed. However, by chemical dissolution of silicates, aluminosilicates, and other minerals soluble in HCl or HF, pyrite is chemically freed from other ash-forming minerals and coal is chemically freed from ash-forming minerals. Freeing one mineral of a locked pair of minerals by dissolving away one member of the pair is fundamentally different than liberation brought about by comminution. In comminution locked particles of pyrite and aluminosilicate (or coal and aluminosilicates) are only liberated from each other if they are made smaller and smaller, and even then there will remain a few locked particles. In contrast, the freeing of pyrite from aluminosilicates (or coal from aluminosilicates) by chemical dissolution of the aluminosilicates is achieved without any substantial reduction in particle size. To have freed coal and pyrite at the large grain sizes is an enormous advantage because separation processes are more efficient with larger sizes.

By chemically dissolving the aluminosilicates both coal and pyrite seek their natural specific gravities (about 1.3 and 5.2, respectively). Whereas coal before the dissolution process is comprised of a continuum of specific gravities, after chemical leaching there is a bimodal distribution of coal at light gravities and pyrite (barite and other heavy minerals) at high specific gravities. Accordingly, a sharp separation is easily made by any of several possible processes based upon physical differences between coal and pyrite, e.g. specific gravity, magnetic susceptibility, hydrophobicity, etc.

The separation possible at a specific gravity of 1.8 is shown in Table 20. The data in Table 21 compare the specific gravity distribution of a raw coal 28-mesh by zero and a leached product derived therefrom, also 28-mesh by zero. Of importance in this comparison are the following:

The 8.5 weight percent in the feed in the 1.5 to 1.8 specific gravity range was completely partitioned into coal (sp. gr. $<1.50$) and pyrite (sp. gr. $>2.96$).

The 0.4% at 1.8 to 2.1 was also so partitioned.

The 7.1% at 2.1 to 2.96, the range of most aluminosilicate and rock minerals was also eliminated partitioning any locked coal or pyrite to their respective gravities.

General comminution was not required to achieve the partitioning of coal and pyrite to light and heavy gravities, respectively. In fact, both feed coal and leached product are 28-mesh by zero; not one 28-mesh by zero and the other 65-mesh by zero.

TABLE 20

Results of Preliminary Sink-Float Test on Leached Coal Product (Test 209)

| Product | Direct Wt % | Ash % | Pyritic Sulfur % | Pyritic Sulfur Distribution % | Ash Distribution % |
|---|---|---|---|---|---|
| 1.80 float | 98.41 | 0.50 | 0.05 | 15.2 | 57.0 |
| 1.80 sink | 1.59 | 23.3[1] | 17.2[1] | 84.8 | 43.0 |
| Feed | 100.00 | 13.73 | 0.58 | 100 | 100 |

[1]Calculated by difference.

TABLE 21

Centrifuge Sink-Float Results (Westmoreland Coal, Absaloka Mine)

| | Specific Gravity Sink | Specific Gravity Float | Direct Wt %[2] |
|---|---|---|---|
| Raw, 28 M × coal | | 1.30 | 0.5 |
| Test 262 | 1.30 | 1.40 | 64.0 |
| | 1.40 | 1.50 | 16.8 |
| | 1.50 | 1.80 | 8.5 |
| | 1.80 | 2.10 | 0.4 |
| | 2.10 | 2.96 | 7.1 |
| | 2.96 | | 2.7 |
| Leached coal product | | 1.30 | 7.1 |
| Test 263[1] | 1.30 | 1.40 | 75.4 |
| | 1.40 | 1.50 | 13.0 |
| | 1.50 | 1.80 | 0 |
| | 1.80 | 2.10 | 0 |
| | 2.10 | 2.96 | 0 |
| | 2.96 | | 4.5 |

[1]2-stage leach conditions (Test 260, large-scale batch leach)
a. Feed: raw 28-mesh by zero Powder River Basin (Absaloka Mine) coal.
b. 10% HCl, 10% solids, ambient temperature, 2 hr, 5 displacement washes.
c. 20% HF, 10% solids, ambient temperature, 4 hr, 5 displacement washes plus 18 hr long-term wash.

EXAMPLE 11

A sample of HCl and HF leached Absaloka Mine coal (about 7 pounds) was separated into clean, middling and refuse products on a small laboratory shaking table. The clean coal fraction from tabling was subsequently leached in HCl for additional mineral matter removal. These data appear in Table 22.

TABLE 22

Sulfur Removal by Physical Separation Tabling and Post Leach Test Results (Westmoreland Coal, Absaloka Mine)

| Test Sample Description | 260 Feed (Leached Coal Product)[1] | 261 Tabling Products: Clean Fraction | Middling Fraction | Refuse Fraction | 344 HCL Post Leach[2] |
|---|---|---|---|---|---|
| Ash, % | 1.19 | 0.55 | 0.65 | 26.85 | 0.46 |
| Sulfur, % | | | | | |
| Total | 0.94 | 0.62 | 0.64 | 17.11 | 0.60 |
| Sulfate | 0.03 | 0.02 | 0.01 | 0.46 | 0.00 |
| Pyritic | 0.32 | 0.08 | 0.13 | 13.86 | 0.09 |
| Ash composition, % | | | | | |
| $SiO_2$ | 7.32 | 17.96 | 23.60 | 3.45 | 21.12 |

TABLE 22-continued

| Sulfur Removal by Physical Separation Tabling and Post Leach Test Results (Westmoreland Coal, Absaloka Mine) | | | | | |
|---|---|---|---|---|---|
| | 260 | 261 | | | 344 |
| | Feed | Tabling Products | | | |
| Test Sample Description | (Leached Coal Product)[1] | Clean Fraction | Middling Fraction | Refuse Fraction | HCL Post Leach[2] |
| $Al_2O_3$ | 4.78 | 8.89 | 7.08 | 0.86 | 9.09 |
| CaO | 9.39 | 18.85 | 14.00 | 0.68 | 15.74 |
| MgO | 2.15 | 3.55 | 2.50 | 0.47 | 2.58 |
| $Fe_2O_3$ | 54.20 | 20.33 | 30.80 | 84.08 | 23.95 |
| $TiO_2$ | 3.93 | 6.26 | 3.59 | 0.19 | 9.06 |
| $Na_2O$ | 0.425 | 1.68 | 0.588 | 0.050 | 0.350 |
| $K_2O$ | 0.204 | 0.948 | 0.783 | 0.122 | 0.727 |
| $P_2O_5$ | 3.16 | 4.22 | 3.73 | 1.05 | 3.20 |
| $SO_3$ | 10.91 | 17.82 | 12.73 | 4.92 | 14.37 |
| Total | 96.47 | 100.51 | 99.40 | 95.87 | 100.19 |

[1]Batch leach on raw 28 M × 0 coal in two stages: 1. 10% HCL, 10% solids, ambient temperature (22° C.), 2 hr, 5 displacement DI water washes. 2. 20% HF, 10% solids, ambient temperature (22° C.), 4 hr, 2 reslurry DI water washes.
[2]Clean fraction from tabling products. Post leach conditions: 10% HCL, 10% solids, 2 hr, ambient temperature, 5 displacement washes.

EXAMPLE 12

The products which were washed with ammonium or other hydroxides appeared to have more fines than products washed with water. To quantify this observation comparative tests were made. Three purged hydrocarbon products from earlier tests (220, 221, 222) were screened at 100-mesh (Tyler) and treated as shown in Table 23. A sample of raw Absaloka Mine coal was washed with 0.1% ammonium hydroxide and then subjected to the same procedure used for washing one of the three purged hydrocarbon product samples (Test 222), i.e., agitation for 18 hours, followed by filtration, five deionized water washes, and air drying. The test sample product was then screened at 100-mesh. A further sample of the minus 28-mesh raw coal which had not been washed was prepared by screening at 100-mesh.

The amount of minus 100-mesh fines in each sample is reported in Table 23.

TABLE 23

| Test | Solid | Wash Reagent | % Minus 100-mesh |
|---|---|---|---|
| 220 feed | Leached coal product[1] | None | 30.4 |
| 221 | Leached coal product[1] | DI water | 44.5 |

TABLE 23-continued

| Test | Solid | Wash Reagent | % Minus 100-mesh |
|---|---|---|---|
| 222 | Leached coal product[1] | 0.1% $NH_4OH$ | 92.4 |
| Feed | Raw coal (28 M × 0) | None | 25.4 |
| 250 | Raw coal (28 M × 0) | 0.1% $NH_4OH$ | 70.5 |

[1]All leached coal product was derived from leaching 28-Mesh by zero coal.

EXAMPLE 13

Alternate Acids

Although hydrochloric and (HCl) has been successful in producing low-ash leached coal, other acids for various reasons may be preferred for example to preclude residual chloride in the leached coal product.

Two series of nitric acid leach tests, and leach tests using acetic acid and HF were conducted to test these acids as alternatives to HCl.

Feed materials used and test conditions are given in Table 24. After drying, the resulting cleaned, leached coal product from the tests was analyzed for ash, forms of sulfur, heating value, nitrogen and ash composition and these results are also reported in Table 24.

TABLE 24

Evaluation of Alternate Acids to Replace HCl (Results on a Dry Basis)

| Test No. | Leach Conditions[1] Acid | Acid Conc. | Temp °C. | Time, hr. | %[4] Ash | % Sulfur Total | Sulfate | Pyrite | Heating Value Btu/lb | Nitrogen % | Fluoride ppm |
|---|---|---|---|---|---|---|---|---|---|---|---|
| 28 × 0 Raw Coal (Feed to leach) | — | — | — | — | 13.73 | 1.03 | 0.02 | 0.58 | 11231 | 0.92 | 78 |
| 217-3/1 | $HNO_3$ | 15% | Ambient | 2 | 8.25 | 1.06 | 0.02 | 0.43 | 11851 | 1.07 | 60 |
| 217-6/2 | HF | 20% | Ambient | 4 | 1.20 | 1.12 | 0.03 | 0.42 | 13443 | 1.22 | 2010 |
| 342-1 | Acetic | 10% | Ambient | 2 | 10.93 | 1.26 | 0.03 | 0.52 | 11533 | — | 94 |
| 342-2 | HF | 20% | Ambient | 4 | 1.77 | 0.97 | 0.01 | 0.35 | 12756 | — | 4390 |
| 342-3 | Acetic | 20% | 90 | 2 | 1.46 | 1.10 | 0.02 | 0.35 | 12803 | — | 1920 |
| 265-Feed[2] | — | — | — | — | 1.23 | 1.20 | 0.02 | 0.32 | 12726 | 1.01 | — |
| 266[3] | $HNO_3$ | 0.5% | 90 | 1 | 1.13 | 1.25 | 0.02 | 0.31 | 12843 | 1.07 | — |
| 267[3] | $HNO_3$ | 5% | 90 | 1 | 0.89 | 1.03 | 0.02 | 0.18 | 10951 | 3.73 | — |

| Test No. | Leach Conditions[1] Acid | Acid Conc. | Temp °C. | Time, hr. | % in ash $SiO_2$ | $Al_2O_3$ | CaO | MgO | $Fe_2O_3$ |
|---|---|---|---|---|---|---|---|---|---|
| 28 × 0 /Raw (Feed to leach) | — | — | — | — | 36.51 | 14.98 | 22.81 | 2.36 | 6.35 |
| 217-3/1 | $HNO_3$ | 15% | Ambient | 2 | 59.38 | 24.54 | 1.83 | 1.01 | 9.12 |

TABLE 24-continued

Evaluation of Alternate Acids to Replace HCl
(Results on a Dry Basis)

| | | | | | | | | | |
|---|---|---|---|---|---|---|---|---|---|
| 217-6/2 | HF | 20% | Ambient | 4 | 7.05 | 5.03 | 8.13 | 1.57 | 56.77 |
| 342-1 | Acetic | 10% | Ambient | 2 | 51.32 | 22.31 | 4.42 | 1.07 | 10.22 |
| 342-2 | HF | 20% | Ambient | 4 | 4.41 | 8.81 | 20.60 | 1.57 | 31.50 |
| 342-3 | Acetic | 20% | 90 | 2 | 4.12 | 6.13 | 14.02 | 1.28 | 46.51 |
| 265-Feed[2] | — | — | — | — | 12.41 | 4.98 | 7.54 | 0.78 | 49.44 |
| 266[3] | $HNO_3$ | 0.5% | 90 | 1 | 10.91 | 3.22 | 5.24 | 0.49 | 58.83 |
| 267[3] | $HNO_3$ | 5% | 90 | 1 | 13.92 | 2.47 | 3.83 | 0.55 | 56.76 |

| Test | Leach Conditions[1] | | | | % in ash | | | | |
|---|---|---|---|---|---|---|---|---|---|
| No. | Acid | Acid Conc. | Temp °C. | Time, hr. | $TiO_2$ | $Na_2O$ | $K_2O$ | $P_2O_5$ | $SO_3$ |
| 28 × 0 /Raw (Feed to leach) | — | — | — | — | 0.71 | 3.37 | 0.50 | 1.33 | 11.45 |
| 217-3/1 | $HNO_3$ | 15% | Ambient | 2 | 1.22 | 0.113 | 0.919 | 1.87 | 1.70 |
| 217-6/2 | HF | 20% | Ambient | 4 | 3.51 | 0.166 | 0.155 | 3.18 | 10.26 |
| 342-1 | Acetic | 10% | Ambient | 2 | 1.09 | 0.125 | 1.035 | 1.91 | 4.84 |
| 342-2 | HF | 20% | Ambient | 4 | 2.35 | 0.233 | 0.295 | 2.60 | 27.20 |
| 342-3 | Acetic | 20% | 90 | 2 | 2.57 | 0.144 | 0.117 | 1.65 | 20.24 |
| 265-Feed[2] | — | — | — | — | 3.62 | 0.01 | 0.11 | 1.01 | 10.98 |
| 266[3] | $HNO_3$ | 0.5% | 90 | 1 | 3.72 | 0.01 | 0.06 | 0.29 | 8.38 |
| 267[3] | $HNO_3$ | 5% | 90 | 1 | 4.48 | 0.01 | 0.12 | 0.19 | 7.59 |

[1]10% solids.
[2]Purged hydrocarbon from 2-stage leach on 28 M × 0 raw coal:
1. 10% HCl, 10% solids, ambient temp. (22° C.), 2 hr., 5 displacement washes.
2. 20% HF, 10% solids, ambient temp. (22° C.), 2 hr., 5 displacement washes.
[3]Additional leach condition: 5 displacement washes.
[4]Test No. 265,266,267; 5 gram samples.

EXAMPLE 14

A series of tests were designed to test the effectiveness of heat treatment for removal of residual halogens, chlorine and fluorine, from coal solids after the acid leaches. Tests were conducted with both Ulan cleaned coal and Western, sub-bituminous cleaned coal samples.

The Ulan sample was produced by an HF leach followed by an 18-hour wash and tabling. After receipt from Australia, the 3-mm×0.1-mm sample was rinsed with deionized water and dried at 90° C. The fluorine content of this sample was 5636 ppm and the volatile matter was 33.61% (both on a dry basis).

The Western cleaned coal sample was produced by a three-stage sequential leach of 28-mesh×0, raw coal from the Powder River Basin in Montana. The chlorine and fluorine contents of this sample were 1617 ppm and 118 ppm, respectively.

The baking process was conducted in fluid bed reactors (FBR's).

Test conditions and results are summarized in Table 25.

EXAMPLE 15

A test was conducted to determine the effect of $NH_3$ on the removal of halogens during heat treatment. A batch sample of Eastern coal was processed to produce cleaned carbons.

The purged carbons were produced from Eastern, 2-inch by 0 coal obtained from Westmoreland Coal Company's Hampton 3 preparation plant. The cleaned coal is a blend of two seams from Boone County, W. Va.: 85% Cedar Grove and 15% Stockton-Lewiston. The coal was processed according to the following steps:

1. Leach 1: 10% HCl, 75° C., 2 hours, 30% solids, two deionized water washes on the filter.
2. Leach 2: 20% HF/15% HCl, ambient temperature, 4 hours, 30% solids, one deionized water wash on the filter.
3. Long term wash: ambient temperature, 18 hours, 30% solids in deionized $H_2O$.
4. Wet tabling: only the clean coal product was baked.
5. Drying: forced-air oven, 60° C., 48 hours.

TABLE 25

Halogen Removal by Heat Treatment - Summary of Conditions and Results

| Run | | Analysis, ppm | | Sweep Gas | Flow Rate | Oper. Temp | Product Sample Analyses, ppm - Fluorine or (Chlorine) Time at Temperature, hr[2] | | | | | | | | | | |
|---|---|---|---|---|---|---|---|---|---|---|---|---|---|---|---|---|---|
| No. | FBR[1] | F | Cl | Type | scfm | °C. | 0 | 0.5 | 1.0 | 1.5 | 2.0 | 2.5 | 3.0 | 3.5 | 4.0 | 4.0 | 5.0 |
| 1 | 4" | 5,636 | — | $N_2$ | 3 | 300 | 1051 | 876 | 754 | 676 | 653 | 620 | 620 | 605 | 563 | — | — |
| 2 | 4" | 5,636 | — | $N_2$ | 3 | 300 | 1162 | 833 | 745 | — | 673 | — | 588 | 545 | — | — | 498 |
| 3 | 6" | 2,747 | — | $N_2$ | 10 | 300 | 890 | — | — | 567 | — | — | — | — | — | — | — |
| 4 | 6" | — | — | $N_2$ | 10 | 325 | 507 | — | 414 | — | 357 | — | — | — | — | — | — |
| 5 | 6" | — | — | $N_2$ | 10 | 350 | 357 | 253 | 243 | — | 243 | — | — | — | — | — | — |
| 6 | 4" | 2,747 | — | $N_2$ | 3 | 350 | 429 | 275 | 256 | 299 | 236 | 210 | 200 | — | — | — | — |
| 7 | 4" | 2,747 | — | $CO_2$ | 3 | 350 | 429 | 275 | 256 | 229 | 236 | 210 | 200 | — | — | — | — |
| 8 | 6" | 5,636 | — | $N_2$ | 10 | 300–350 | 1185 | 624 | 381 | 355 | 317 | 255 | 270 | — | — | — | — |
| 9 | 6" | 5,636 | — | $N_2$ | 10 | 300–350 | 623 | 475 | 170 | 148 | 134 | 105 | 112 | — | — | — | — |
| | | | | Steam | 2.4 | | | | | | | | | | | | |
| 10 | 6" | 118 | 1,617 | $N_2$ | 10 | 325 | (558) | (331) | (232) | (176) | (171) | (132) | — | — | — | — | — |
| | | | | Steam | 2.2 | | | | | | | | | | | | |

[1]FBR = fluid-bed reactor.
[2]Times for Runs 8 and 9 are approximate.
All Tests on Ulan coal (Australia) except No. 10 which is sub-bituminous coal from Western U.S.

After drying, the purged carbons were baked in a 6-inch diameter, Pyrex glass fluid-bed reactor (FBR) at 325° C. The fluidizing medium was approximately 10 scfm nitrogen containing about 20% water. Water was introduced into the nitrogen gas stream before the gas preheater and vaporized in the preheater. Purged carbons were fed continuously to the FBR at a rate of 25 grams per minute to provide a residence time of about two hours in the 3000-gram capacity bed. Material was withdrawn periodically via a bed overflow port, weighed, and analyzed for chlorine and fluorine.

Prior to baking, the purged carbons contained 10,350 ppm chlorine and 2240 ppm fluorine. At one point in the baking test the chlorine and fluorine in a baked sample were analyzed at 1721 and 874 ppm, respectively. Ammonium hydroxide was then added to the water entering the preheater to produce a concentration of 0.1% $NH_3$. A comparison of the halogen concentrations in the cleaned coal before and after ammonia addition is shown below in Table 26.

TABLE 26

| | Cl, ppm | F, ppm | N, % |
|---|---|---|---|
| Sample 1 (before $NH_3$ addition) | 1721 | 874 | 1.50 |
| Sample 2 (after $NH_3$ addition) | 1327 | 832 | 1.54 |

Although the foregoing invention has been described in detail and by way of example for purposes of clarity and understanding, as will be known and understood by those skilled in the art, changes and modifications may be made without departing from the spirit of the invention which is limited only by the appended claims.

What is claimed is:

1. A process for producing a coal product from coal and coal derivatives, said coal product having a mineral matter content of less than about 5 percent by weight comprising the steps of:
   (a) contacting coal of a size less than about an inch with an aqueous HF acid leach to solubilize at least a portion of said mineral matter;
   (b) separating the spent HF leachate and impurities dissolved therein from the coal;
   (c) contacting said coal from step (b) with an aqueous HCl acid leach;
   (d) separating the spent HCl leachate and the impurities dissolved therein from the coal;
   (e) removing pyrite from said leached coal to produce a coal product substantially free of pyrite;
   (f) treating said coal product to remove any halogens present as volatile halides;
   (g) regenerating acids by contacting said acid leachate in the presence of added $SO_2$ and oxygen with water vapor under reaction conditions selected to regenerate an acid selected from the group consisting of HF and HCl and to form a residue comprising the oxides of Al and Fe and the sulfates of one or more of the group consisting of Ca, K, and Na; and
   (h) recycling said regenerated acids to the respective leaches.

2. A process according to claim 1 wherein said coal is comminuted to a size less than about 5 mm.

3. A process according to claim 2 wherein said coal is comminuted to a size less than ½ mm.

4. A process according to claim 1 further comprising pre-leaching said coal with a hydrochloric acid leach wherein said acid leach comprises from about 1 to about 20 percent by weight hydrochloric acid; and wherein said hydrochloric acid leach is at a temperature of about 40° C. to form a pre-leached coal and a spent HCl leach liquor.

5. A process according to claim 4 wherein said spent HCl leach liquor and said pre-leach coal are separated.

6. A method according to claim 5 wherein said spent HCl leach liquor undergoes pyrohydrolysis to regenerate said HCl acid and wherein said regenerated HCl acid is recycled to the hydrochloric pre-leach step.

7. A process according to claim 1 wherein said HF leach is conducted in a two-stage countercurrent leach system.

8. A process according to claim 1 wherein the concentration of said HF leach is in the range of from about 5 to about 70 weight percent.

9. A process according to claim 8 wherein said concentration of HF leach is in the range of from about 15 to about 30 weight percent.

10. A process according to claim 1 wherein the second stage of a countercurrent HF leach is at a concentration of 20 percent HF.

11. A process according to claim 1 wherein said HF leach is conducted at a temperature of from about 10° C. to incipient boiling.

12. The process according to claim 11 wherein said temperature is at a range of from about 10° to about 40° C.

13. A process according to claim 1 wherein said contacting of step (a) is for a time period sufficient to solubilize a substantial amount of the mineral matter and the total time is from about 1/6 to about 8 hours.

14. A process according to claim 1 wherein the concentration of said HCl leach is from about 3 to about 38 weight percent HCL and said contacting with HCl leach is for a time period of from about 1/6 to about 4 hours at a temperature of from about 40° to incipient boiling.

15. A process according to claim 14 wherein concentration of said HCl acid leach is from about 5 to 15 weight percent HCl and for a time period of from about 1 to about 2 hours and at a temperature range of from about 80° C. to incipient boiling.

16. A process according to claim 1 wherein said separated coal of step (b) is washed with water prior to said HCl acid leach.

17. A process according to claim 1 wherein said separated coal of step (d) is washed with water prior to said pyrite removal.

18. A process according to claim 1 wherein said separation of step (e) is by gravity separation.

19. A process according to claim 1 wherein said physical separation of step (e) is magnetic separation.

20. A process according to claim 1 wherein said treating of step (f) comprises heating to a temperature of from about 225° C. to about 400° C. for a time sufficient to remove any halogens present in said coal product as volatile halides to an amount below about ½ percent by weight.

21. A process according to claim 1 wherein said treating of step (f) comprises washing at a temperature less than boiling with a wash selected from the group consisting of water, acetic acid, alcohol, ammonium hydroxide, nitric acid, and mixtures thereof and then heating the coal product to dry it.

22. A process according to claim 1 wherein said HF acid leach liquor separated in step (b) contains coal fines and further comprising regenerating said HF leachate in a pyrohydrolyzer fired at least in part by said coal fines.

23. A process according to claim 1 in which said contacting of step (c) comprises co-current leaching.

* * * * *

UNITED STATES PATENT AND TRADEMARK OFFICE

CERTIFICATE OF CORRECTION

PATENT NO. : 4,743,271

DATED : May 10, 1988

INVENTOR(S) : Kindig, et al.

It is certified that error appears in the above—identified patent and that said Letters Patent is hereby corrected as shown below:

Column 5, line 8, delete "interface" and insert therefor --interfere--

Column 9, line 3, delete "mixtures" and insert therefor --mixture--

Signed and Sealed this

First Day of November, 1988

*Attest:*

DONALD J. QUIGG

*Attesting Officer*

*Commissioner of Patents and Trademarks*